US011794229B2

(12) United States Patent
Huba

(10) Patent No.: US 11,794,229 B2
(45) Date of Patent: Oct. 24, 2023

(54) EXTRUSION MACHINE, METHOD FOR DISTANCE CONTROL AND METHOD FOR CHANGING A FRICTION WHEEL IN AN EXTRUSION MACHINE

(71) Applicant: Asmag-Holding GmbH, Gruenau im Almtal (AT)

(72) Inventor: Mikola Huba, Regau (AT)

(73) Assignee: ASMAG-HOLDING GMBH, Gruenau Im Almtal (AT)

( * ) Notice: Subject to any disclaimer, the term of this patent is extended or adjusted under 35 U.S.C. 154(b) by 0 days.

(21) Appl. No.: 17/850,061

(22) Filed: Jun. 27, 2022

(65) Prior Publication Data

US 2022/0324006 A1 Oct. 13, 2022

Related U.S. Application Data

(62) Division of application No. 16/618,216, filed as application No. PCT/AT2018/060114 on Jun. 1, 2018, now Pat. No. 11,446,721.

(30) Foreign Application Priority Data

Jun. 2, 2017 (AT) ..... A 50469/2017

(51) Int. Cl.
*B21C 23/00* (2006.01)

(52) U.S. Cl.
CPC ..... *B21C 23/005* (2013.01)

(58) Field of Classification Search
CPC ... B21C 23/005; B21C 23/212; B21C 23/214; B21C 23/215; B30B 11/22
See application file for complete search history.

(56) References Cited

U.S. PATENT DOCUMENTS 3,391,565 A * 7/1968 Linnerz ..... B21C 23/214 72/263
4,523,444 A 6/1985 Fuchs, Jr.
(Continued)

FOREIGN PATENT DOCUMENTS

DE 10 2007 033 205 A1 2/2008
EP 0 408 259 B1 6/1994
(Continued)

OTHER PUBLICATIONS

International Search Report in PCT/AT2018/060114, dated Jan. 23, 2019.

*Primary Examiner* — Katrina M Stransky
*Assistant Examiner* — P Derek Pressley
(74) *Attorney, Agent, or Firm* — Collard & Roe, P.C.

(57) ABSTRACT

An extrusion machine includes a main frame, a friction wheel, a tool holding device, a locking device and a tool unit supported on the tool holding device. Furthermore, a shielding unit with at least one first nozzle and at least one second nozzle is provided, wherein the nozzles are formed to emit a gas which is free of gaseous oxygen. The first nozzle is directed at a peripheral portion of the friction wheel. The second nozzle is arranged below a stripping area of the tool unit. Further, an extrusion machine has a sensor unit between the tool holding device and the tool unit and a method controls distance between two tool components of the extrusion machine. Furthermore, different extrusion machines as well as methods for changing friction wheels are provided.

13 Claims, 9 Drawing Sheets

(56) References Cited

U.S. PATENT DOCUMENTS

| | | | | |
|---|---|---|---|---|
| 5,157,955 | A | 10/1992 | Hawkes et al. | |
| 5,782,120 | A | 7/1998 | Wright | |
| 6,011,376 | A | 1/2000 | O'Bryan et al. | |
| 6,415,849 | B1 | 7/2002 | Hohenbichler et al. | |
| 6,871,522 | B2 | 3/2005 | Maddock et al. | |
| 9,468,960 | B2 | 10/2016 | Wilson et al. | |
| 10,376,939 | B2 | 8/2019 | Vielhaber | |
| 2006/0156782 | A1 | 7/2006 | Hawkes | |
| 2015/0151343 | A1 | 6/2015 | Strong | |
| 2016/0361743 | A1* | 12/2016 | Vielhaber | ..... B21C 23/212 |

FOREIGN PATENT DOCUMENTS

| | | | | |
|---|---|---|---|---|
| GB | 2 241 660 | A | 9/1991 | |
| GB | 2 310 627 | A | 9/1997 | |
| GB | 2 386 334 | A | 9/2003 | |
| JP | H10-166035 | A | 6/1998 | |
| KR | 100862792 | B1 | 10/2008 | |
| WO | 96/02335 | A1 | 2/1996 | |
| WO | 00/29141 | A1 | 5/2000 | |
| WO | 2012/119196 | A1 | 9/2012 | |
| WO | 2014/056796 | A1 | 4/2014 | |
| WO | 2015/070274 | A1 | 5/2015 | |
| WO | WO-2015070274 | A2 * | 5/2015 | ..... B21C 23/005 |

* cited by examiner

PRIOR ART

EXTRUSION MACHINE, METHOD FOR DISTANCE CONTROL AND METHOD FOR CHANGING A FRICTION WHEEL IN AN EXTRUSION MACHINE

CROSS REFERENCE TO RELATED APPLICATIONS

This application is a divisional of and Applicant claims priority under 35 U.S.C. §§ 120 and 121 of U.S. application Ser. No. 16/618,216 filed on Jan. 9, 2020, which application is a national stage application under 35 U.S.C. § 371 of PCT Application No. PCT/AT2018/060114 filed on Jun. 1, 2018, which claims priority under 35 U.S.C. § 119 from Austrian Patent Application No. A50469/2017 filed on Jun. 2, 2017, the disclosures of each of which are hereby incorporated by reference. A certified copy of priority Austrian Patent Application No. A50469/2017 is contained in parent U.S. patent application Ser. No. 16/618,216. The International Application under PCT article 21(2) was not published in English.

BACKGROUND OF THE INVENTION

1. Field of the Invention

The invention relates to an extrusion machine for the continuous manufacture of profiles from a mouldable extrusion material. The invention also relates to a method for controlling the distance between two tool components of such an extrusion machine. The invention also relates to a method for changing a friction wheel of an extrusion machine which is in drive connection with a drive device.

2. Description of the Related Art

A generically designed extrusion machine has become known from WO 2015/070274 A1. The extrusion machine serves for the continuous manufacture of profiles from a mouldable extrusion material and comprises a main frame, a friction wheel rotatable about a drive axis, a tool holding device, a locking device and a tool unit supported on the tool holding device. The tool holding device is mounted on a pivot axis held on the main frame and can be pivoted between a working position and a release position. The locking device holds the tool holding device in its working position. The tool unit is further accommodated in an accommodation chamber arranged in the tool holding device and comprises a stripping element arranged in a stripping area. With this extrusion machine a measuring device for direct determination of the actual gap width in the area between the friction wheel and the tool unit with its stripping element is described, which, however, has not been able to be realized in practice in this form. Furthermore, an overload of the machine has only been able to be detected when damage to the machine had occurred. It has also not been possible to minimise or prevent oxygen absorption during the moulding process into the material to be moulded. Although a possibility of changing the friction wheel by dismantling a part of the drive shaft was mentioned, the accessibility and the associated handling of the friction wheel to be changed were not sufficient.

SUMMARY OF THE INVENTION

The purpose of the present invention was to overcome the disadvantages of the state of the art and to provide an extrusion machine and a method by means of which a user is able to carry out safe and economic operation of the extrusion machine. In addition or independently of this, however, a higher quality of the manufactured profile should also be achievable. In addition, the friction wheel change should be made easier and safer for the operator.

These tasks are solved by an extrusion machine and/or by a method according to the requirements.

The extrusion machine according to the invention serves for the continuous manufacture of profiles from a mouldable extrusion material and may comprise at least the following machine components:

- a main frame,
- at least one friction wheel rotatable about a drive axis, which friction wheel is provided with at least one peripheral groove, and is in drive connection with a drive device,
- a tool holding device which is mounted on a pivot axis held on the main frame and can be pivoted about the pivot axis between a working position and a release position, wherein the tool holding device is arranged downstream of the friction wheel, as viewed in the pass-through direction of the profile to be manufactured,
- a locking device, which locking device in its locking position holds the tool holding device locked in its working position relative to the main frame,
- at least one tool unit, which tool unit is supported on the tool holding device, in particular is accommodated in an accommodation chamber arranged in the tool holding device, and contains or forms at least one stripping area with at least one stripping element for the extrusion material to be moulded from the friction wheel, characterised in

- that a shielding unit is provided,
- that the shielding unit comprises at least one first nozzle and at least one second nozzle,
- that the at least one first nozzle and the at least one second nozzle are each formed to emit a gas which is free of gaseous oxygen to minimize or prevent access of ambient air to the heated extrusion material
- that the at least one first nozzle is directed towards a peripheral portion of the friction wheel, which peripheral portion is provided for contact with the supplied extrusion material,
- that the at least one second nozzle is arranged below the stripping area of the tool unit.

The advantage achieved by this is that by providing an additional shielding unit within the extrusion machine in the area where the extrusion material to be moulded is heated by the friction wheel to the required moulding temperature, the ingress of oxygen, as it is present in the ambient air, can be minimized or completely prevented. A gas which is free of gaseous oxygen can thus be supplied by means of the nozzles provided in order to create an oxygen-poor or oxygen-free atmosphere in this area or machine portion. This means that the high initial quality of the still unmoulded extrusion material or at least a very high percentage of it in the manufactured profile can be maintained. Thus, especially in an outer edge area of the profile, oxygen absorption can be greatly minimized or completely prevented thereby achieving even higher quality in the manufacture of the profiles.

Furthermore, it can be advantageous if at least one of the nozzles is arranged or formed on the tool unit. If at least one of the nozzles is arranged on the tool unit, a reliable shielding effect can be achieved in the area with the highest material temperature. In addition, the feeding and supply of the nozzles with the gas, in particular its conduits can be simplified via the tool unit and the tool holding device.

Another embodiment is characterised in that the shielding unit further comprises at least one butterfly valve, and the at least one butterfly valve of the at least one first nozzle is arranged in the area of the peripheral portion of the friction wheel and, as viewed in the direction of rotation of the friction wheel, upstream of the first nozzle. By providing at least one butterfly valve in the feed area of the extrusion material, the outflow of the supplied gas can be reduced and thus the consumption of the same. However, this also makes it easier to create a better shielded space with a lower gas pressure inside the extrusion machine, which is higher than the ambient pressure, in order to further improve the shielding effect.

A further possible embodiment has the features that the shielding unit comprises a further nozzle arrangement, which further nozzle arrangement is arranged downstream of the at least one second nozzle, as viewed in the direction of rotation of the friction wheel. Thus, an additional shielding effect can also be created in the area following the stripping area in the direction of rotation of the friction wheel. Thus, an additional locking curtain can be provided to prevent the entry of oxygen.

The invention also relates to a further, possibly independent, embodiment of an extrusion machine for the continuous manufacture of profiles from a mouldable extrusion material. The extrusion machine can also be combined with the embodiments of the extrusion machine described above and may include at least the following machine components:

- a main frame,
- at least one friction wheel rotatable about a drive axis, which friction wheel is provided with at least one peripheral groove and is in drive connection with a drive device,
- a tool holding device, which is mounted on a pivot axis held on the main frame and can be pivoted about the pivot axis between a working position and a release position, the tool holding device being arranged downstream of the friction wheel, as viewed in the pass-through direction of the profile to be manufactured,
- a locking device, which locking device in its locking position holds the tool holding device locked in its working position relative to the main frame,
- at least one tool unit, which tool unit is supported on the tool holding device, in particular is accommodated in an accommodation chamber arranged in the tool holding device, and includes or forms at least one stripping area facing the friction wheel with at least one stripping element for the extrusion material to be moulded by the friction wheel, wherein
- the tool unit is supported on its side facing away from the friction wheel with the interposition of a first sensor unit on the tool holding device, in particular on a first adjusting surface of the accommodation chamber.

The advantage of this is that, by providing the sensor unit to determine a compression force transmitted from the tool unit to the tool holding device, and with prior knowledge of the moulding force normally required, a conclusion can be drawn quickly in the event of changes and deviations from the latter. Thus, for example, damage to the extrusion machine can be avoided in the event of an increase in the moulding force and the associated higher measured compression force. For example, in normal moulding operation, the moulding force required or present can be recorded as a compression force by the sensor unit and stored as a target value with lower and upper limits for each profile geometry. If, for example, the upper limit value is exceeded, the rotation speed of the friction wheel can be reduced, for example, in order to carry out proper moulding operation again within the specified limits without causing damage to the machine.

A further training provides that the first sensor unit comprises several, in particular four, sensors arranged in a peripheral edge area of the tool unit. If several sensors are used to form the first sensor unit, this can provide more uniform support and pressure measurement from the tool unit to the tool holding device.

Furthermore, it can be advantageous if the first sensor unit is in a communication connection with a control and/or regulating device. This allows the currently measured and determined moulding forces and/or compression forces of the tool unit to be compared with specified forces within certain limits and, if they exceed or fall below these limits, operating parameters such as the rotation speed of the friction wheel, the feed speed of the extrusion material, etc., can be adjusted to ensure proper operation of the extrusion machine.

Another embodiment is characterised in that at least one temperature control element is provided, which at least one temperature control element is accommodated in the accommodation chamber and is arranged upstream of the sensor unit in the direction towards the friction wheel, wherein the at least one temperature control element is designed to dissipate heat from the tool unit. This allows heat transfer from the tool unit to the sensor unit to be minimized or reduced. Furthermore, the prevailing temperature in the area of the sensor unit can be kept constant within certain limits in order to achieve more accurate measurement results.

Another preferred embodiment is characterised in that the at least one temperature control element forms a constituent of the tool unit. A compact design of the tool unit can thus be created.

However, the invention also relates to a method for controlling the distance between two tool components of an extrusion machine for the continuous manufacture of profiles from a mouldable extrusion material, comprising the following steps:

- determining or defining a first distance value between a first tool component and a distance measuring device,
- storing the first distance value in a control and/or regulating device,
- approaching and feeding a second tool component to the stationary first tool component until the second tool component abuts against the first tool component;
- displacing the second tool component, which abuts against the first tool component, by a first adjustment travel stored in the control and/or regulating device and, thereby forming a gap between the first tool component and the second tool component with a base gap width;
- initial operation of the extrusion machine and thereby feeding the extrusion material into the extrusion machine to the first tool component and moulding the extrusion material into the profile;
- further determining further distance values between the first tool component and the distance measuring device in the moulding operation of the extrusion machine,
- forming a distance difference value from the first distance value minus one of the further distance values,
- calculating an actual value of a gap width between the first tool component and the second tool component, the distance difference value being subtracted from the value of the base gap width, determining, whether the actual value of the gap width is within a range of values stored in the control and/or regulating device with a lower target value of the gap width and an upper target value of the gap width, displacing the second tool component away from the first tool component if the gap width falls below the lower target value or displacing the second tool component towards the first tool component if the gap width exceeds the upper target value.

The advantage of the process steps selected here is that a basic distance value can be determined based on the determination of the distance value between the first tool component and the distance measuring device, which serves as a reference for temperature-related length changes of the first tool component. Due to the temperature-related dimensional change, i.e. an increase of the same, further distance values are subsequently determined during the current moulding operation in order to obtain a conclusion on the actual dimension of this tool component. Furthermore, if the base gap width is set in an initial state in which the extrusion machine and the tool components have a low temperature, in particular ambient temperature, the gap width can be readjusted during ongoing moulding operation on the basis of the determined actual value of the gap width. Thus, collisions between tool components of the extrusion machine that move relative to each other can be prevented or avoided.

The initial determination or establishment of the first distance value may also be referred to as a calibration step to provide a reference base for subsequent steps or process features. The readjustment and setting of the gap width can also be called an adjustment step.

Furthermore, a procedure is advantageous in which the determination of the first distance value is carried out at an initial temperature of the first tool component in a temperature range between 10° C. and 40° C. This ensures that the first tool component in its "cold state" has the usual dimensions without temperature-related length changes.

Another advantageous approach is characterised in that the first tool component is formed by a friction wheel of the extrusion machine. This defines the first tool component as a rotating component, which serves to introduce the necessary moulding temperature into the extrusion material to be moulded.

A process variant is also advantageous, in which the second tool component is formed by a tool unit accommodated in a tool holding device and held in position in the tool holding device with at least one stripping element facing the first tool component, in particular the friction wheel. This enables a clear reference to be established between the two tool components for the gap setting.

A different procedure is characterised in that the tool units are each formed with an identical longitudinal extension to one another in their longitudinal extension starting from the stripping element up to a tool end surface arranged at a distance therefrom, as viewed in the pass-through direction of the profile to be manufactured. Thus, a clear, recurring, uniform longitudinal extension of tool units can be defined during the design phase. This simplifies the adjustment of different tool units in the tool holding device, since the stripping element is always arranged in the same relative position with respect to the tool holding device.

Furthermore, a procedure is advantageous in which the tool holding device is pivoted about a pivot axis held on a main frame and can be pivoted between a working position and a release position. This allows a tool change to be easily carried out in the release position.

A further advantageous procedure is characterised in in that, when the second tool component, in particular the tool unit, is in abutment position with the first tool component, in particular the friction wheel, a basic angular position of the tool holding device with respect to the main frame is determined and stored in the control and/or regulating device. Thus, a relative, constantly recurring basic position of the tool holding device with respect to the main frame can be determined and used as a reference base for subsequent resetting processes and adjustment processes.

A process variant is also advantageous in which, after the second tool component, in particular the tool unit, has been moved away from the first tool component, in particular the friction wheel, a target angular position is determined and stored in the control and/or regulating device. With this the predetermined angular position of the still "cold" extrusion machine" can be determined and recorded before the initially operation of the extrusion machine for the moulding process.

Another procedure is characterized in that, after a tool change of the second tool component, in particular of the tool unit, has been carried out, and when the first tool component, in particular the friction wheel, has come to a standstill, the tool holding device together with the second tool component is pivoted from its release position in the direction towards the working position until the relative basic angular position between the tool holding device and the main frame is reached and, thereby, the second tool component, in particular the tool unit, is brought into abutment with the first tool component, in particular the friction wheel. This makes it possible to check and verify whether or not the specified basic angular position is reached when the second tool component mechanically contacts the first tool component.

Furthermore, a procedure is advantageous in which, when the second tool component, in particular the tool unit, is in abutment against the first tool component, in particular the friction wheel, a fault handling routine is started by the control and regulating device even before the relative base angular position between the tool holding device and the main frame is reached. This prevents damage to the machine, which could otherwise be caused by incorrect positioning of the second tool component in the tool holding device. This damage can be quickly and easily detected and can be repaired and eliminated before initial operation.

Another advantageous approach is characterized in that the second tool component is formed by a scraping device with a scraping element. This makes it possible to align and adjust another tool component in relation to the first tool component. In this example this concerns the scraping device with its scraping element.

A process variant is also advantageous in which the scraping element is applied to the first tool component, in particular to the friction wheel, when approaching and feeding in the direction towards the first tool component. This also allows the positioning of the scraper element to be carried out on its own and thus the gap setting to be carried out exactly.

The invention also relates to a further, possibly independent, embodiment of an extrusion machine for the continuous manufacture of profiles from a mouldable extrusion material. The extrusion machine can also be combined with the previously described embodiments of the extrusion machine and may include at least the following machine components, which serve in particular to carry out a friction wheel change process a main frame, a drive unit with a drive device and with a drive shaft, which drive shaft defines a drive axis;

at least one friction wheel rotatable about the drive shaft, which friction wheel is provided with at least one peripheral groove and is in drive connection with the drive device, a bearing unit with a first bearing device and with a second bearing device, the bearing devices being arranged on both sides of the friction wheel, and by means of which bearing devices the drive shaft is rotatable mounted on the main frame, a tool holding device, which tool holding device is mounted on a pivot axis held on the main frame and can be pivoted about the pivot axis between a working position and a release position, wherein the tool holding device is arranged downstream of the friction wheel, as viewed in the pass-through direction of the profile to be manufactured, a locking device, which locking device holds in its locking position the tool holding device locked in its working position relative to the main frame, at least one tool unit, which tool unit is supported on the tool holding device, and further at least one cantilever arm is provided, which at least one cantilever arm is arranged or formed extending in parallel direction with respect to the drive axis, a guide arrangement is provided, which guide arrangement is arranged or formed on the at least one cantilever arm, at least one coupling device is provided, the coupling device having a coupling position and a decoupling position, and that the first bearing device is coupled to the main frame when the coupling device is in the coupling position, and furthermore the first bearing device is guided on the cantilever arm so as to be adjustable along the cantilever arm by means of the guide arrangement when the coupling device is in the decoupling position.

The advantage of this type of extrusion machine is that the accessibility to the friction wheel to be changed can be considerably improved, since the entire first bearing device together with the drive wheel can be moved from the working position inside the main frame to a changing position outside the main frame. For this purpose, the first bearing device is completely removed from the drive shaft, whereby the friction wheel is also removed from the drive shaft and arranged at a distance. In order to be able to carry out an exact adjusting movement of the first bearing device relative to the drive shaft, a separate arm, in particular a cantilever arm, with a guide arrangement is provided, which serves to support the first bearing device during the relative adjusting movement. By means of the coupling device it is possible to keep the entire first bearing device stationary on the main frame. For this purpose, an associated structural unit of the main frame with the drive unit and the bearing unit, in particular the displaceable first bearing device, can be created in the operating state. By displacing or adjusting the first bearing device together with the friction wheel away from its working position within the main frame, access to and the use of aids for carrying out the friction wheel change process can be facilitated for the operating personnel, even in the case of larger and heavier friction wheels, if necessary together with the driving rings. This can also reduce the risk of accidents and increase ease of use. In addition, a faster friction wheel change can be enabled and carried out.

Furthermore, it can be advantageous if the second bearing device together with the drive shaft is arranged in a stationary manner on the main frame. This allows the drive shaft to be mounted overhung on the main frame during the friction wheel change process, while still maintaining sufficient support of the drive shaft during the friction wheel change process.

Another embodiment is characterised in that the at least one cantilever arm extends from the main frame to the side facing away from the drive device. This allows simple and collision-free travel adjustment of the first bearing device. In addition, however, an unobstructed arrangement of the drive unit is also possible.

Another possible embodiment has the features that the at least one cantilever arm is arranged vertically above the drive shaft and the first bearing device is held guided in a suspended arrangement on the at least one cantilever arm or that the one cantilever arm is arranged below the drive shaft and the first bearing device is guided supported on the at least one cantilever arm. Thus, the accessibility for carrying out the friction wheel change to the first bearing device, which is adjusted and decoupled, can be improved even further. This allows sufficient free space to be created even in the floor area with aids such as mobile transport devices, lifting devices or similar. In addition, the floor-side arrangement of the cantilever arm allows for easier support directly on the contact surface for the system.

Another preferred embodiment is characterised in that at least one cantilever arm is held on the main frame. This allows a more precise alignment and positioning of the drive shaft and first bearing device in relation to each other for the friction wheel change process.

A further embodiment provides that the at least one friction wheel is held on the first bearing device, if necessary with the interposition of a driving ring. This allows a joint travel adjustment of the friction wheel together with the first bearing device from the main frame.

A further possible embodiment has the features that a support arrangement is provided and the support arrangement comprises at least one support device, which at least one support device is or are arranged on at least one side, preferably on both sides, facing away from the friction wheel, of the bearing devices on the drive shaft in a form-fit position in the axial direction. By providing at least one of the support arrangements, a safe and permanent power transmission, by means of which the friction wheel is held clamped, can be achieved even with high axial forces to be transmitted to the drive shaft.

It may also be advantageous if the support device comprises at least two support elements and the at least two support elements are arranged on the outside of the drive shaft. Due to the split design of the support device, a safe arrangement on the drive shaft can be achieved with a minimum of space requirement and easy removal and dismantling. The support elements are preferably designed as half shells and thus embrace the drive shaft.

A possible embodiment can be advantageous if a plurality of groove-shaped first recesses arranged spaced apart from one another in the axial direction are provided in the drive shaft and a respective first support flange is formed between directly adjacent first recesses in the axial direction, and that the support elements have second recesses of opposite design and a respective second support flange is formed between second recesses arranged directly adjacent in the axial direction. Due to the annular groove-shaped recesses, a very exact formation and arrangement of these on the drive shaft can be achieved. The support elements, which are of the same design, engage with their second support flanges in the first recesses in the drive shaft. This enables a very precise and almost play-free interlocking and thus a uniform power transmission.

However, the invention also concerns a method for changing a friction wheel, which friction wheel is in drive connection with a drive device and is rotatable about a drive axis defined by a drive shaft. The procedure may include at least the following steps:

- decoupling a coupling device located between a first bearing device and a main frame of the extrusion machine and thereby displacing it from its coupling position into its decoupling position,
- relative displacement of the first bearing device together with the friction wheel held thereon along a guide arrangement arranged or formed on at least one cantilever arm in a parallel direction with respect to the drive axis of the drive shaft,
- removing the friction wheel to be changed from the first bearing device and arranging another friction wheel on the first bearing device,
- adjusting back the first bearing device along the guide arrangement arranged or formed on at least one cantilever arm towards the main frame,
- coupling the first bearing device to the main frame and thereby changing the coupling device from its decoupling position to its coupling position.

The advantage of this procedure is that the accessibility to the friction wheel to be changed can be considerably improved, since the entire first bearing device and also the drive wheel can be moved from the working position inside the main frame to a change position outside the main frame. For this purpose, the first bearing device can be completely removed from the drive shaft, whereby the friction wheel is also removed from the drive shaft and arranged at a distance. In order to be able to carry out an exact adjusting movement of the first bearing device relative to the drive shaft, a separate arm, in particular a cantilever arm, with a guide arrangement is provided, which serves to hold and support the first bearing device during the relative adjusting movement. By means of the coupling device it is possible to keep the entire first bearing device stationary on the main frame. For this purpose, an associated structural unit of the main frame with the drive unit and the bearing unit, in particular the displaceable first bearing device, can be created in the operating state. By displacing or adjusting the first bearing device together with the friction wheel away from its working position within the main frame, access to and the use of aids for carrying out the friction wheel change process can be facilitated for the operating personnel, even in the case of larger and heavier friction wheels, if necessary together with the driving rings. This can also reduce the risk of accidents and increase ease of use. Furthermore, a faster friction wheel change can be enabled and carried out.

Furthermore, it is advantageous to have the drive shaft and a second bearing device, which supports the drive shaft, remain stationary on the main frame during the friction wheel change process. This allows the drive shaft to be mounted overhung on the main frame during the friction wheel change process, while still maintaining sufficient support for the drive shaft during the friction wheel change process.

A method variant is also advantageous, in that the first bearing device is held guided on the cantilever arm located vertically above the drive shaft in a suspended arrangement on the at least one cantilever arm, or in that the one cantilever arm is arranged below the drive shaft and the first bearing device is guided by being supported on the at least one cantilever arm. Thus, the accessibility to the first bearing device, which is adjusted and decoupled, for carrying out the friction wheel change can be improved even further. This allows sufficient free space to be created even in the floor area with aids such as mobile transport devices, lifting devices or similar. Furthermore, the floor-side arrangement of the cantilever arm allows for easier support directly on the contact surface for the system.

The invention also relates to a further, possibly independent, embodiment of an extrusion machine for the continuous manufacture of profiles from a mouldable extrusion material. The extrusion machine comprising

- a main frame,
- a drive unit with a drive device and with a drive shaft, which drive shaft defines a drive axis:
- at least one friction wheel rotatable about the drive shaft, which friction wheel is provided with at least one peripheral groove and is in drive connection with the drive device,
- a bearing unit with a first bearing device and with a second bearing device, wherein the bearing devices are arranged on both sides of the friction wheel, and by means of which bearing devices the drive shaft is rotatable mounted on the main frame,
- a tool holding device, which tool holding device is mounted on a pivot axis held on the main frame and can be pivoted about the pivot axis between a working position and a release position, the tool holding device being positioned downstream of the friction wheel, as viewed in the pass-through direction of the profile to be manufactured,
- a locking device, which locking device in its locking position holds the tool holding device locked in its working position relative to the main frame,
- at least one tool unit, which tool unit is supported on the tool holding device, characterized in

- that at least one cantilever arm is provided, which at least one cantilever arm is arranged or formed extending in parallel direction with respect to the drive axis,
- that a guide arrangement is provided, which guide arrangement is arranged or formed on the at least one cantilever arm,
- that a support arrangement is provided with a support device,
- that the support device is arranged on the side of the second bearing device facing away from the friction wheel and on the side facing the drive device on the drive shaft in a form-fit position in the axial direction, and
- in that the support device comprises at least two support elements and the at least two support elements are arranged on the outside of the drive shaft.

The advantage of this type of extrusion machine is that it is not necessary to move the entire first bearing device away from the main frame, but that the two bearing devices can remain on the main frame for the friction wheel change. By providing the split support device with at least two support elements, it is possible to arrange it safely on the drive shaft and, above all, with minimum space requirements, and to remove and dismantle it easily. The support elements are preferably designed as half shells and thus embrace the drive shaft. This allows the drive shaft to be disengaged from its coupling connection with the drive unit after removing the support device without any further significant rotational movement and to be pulled out of the second bearing device in the axial direction until the friction wheel is released.

An advantageous possible embodiment is characterised in that a plurality of groove-shaped first recesses arranged spaced apart from one another in the axial direction are provided in the drive shaft and a first support flange is formed respectively between first recesses directly adjacent in the axial direction and that the support elements have second recesses of opposite design and a second support flange is formed respectively between second recesses arranged directly adjacent in the axial direction. Due to the annular groove-shaped recesses, a very exact formation and arrangement of these on the drive shaft can be achieved. The support elements, which are of the same design, engage with their second support flanges in the first recesses in the drive shaft. This enables a very precise and almost play-free interlocking and thus a uniform power transmission.

However, the invention also concerns a further method for changing a friction wheel, which friction wheel is in drive connection with a drive device and is rotatable about a drive axis defined by a drive shaft. The method may include at least the following steps:

- removal of the axial tensioning force applied by a tensioning device between the friction wheel and the drive shaft,
- release of the coupling connection between the drive shaft and a coupling of a drive unit,
- release of the form-fit engagement of at least two support elements of a support device with the drive shaft,
- displacing the drive shaft in the axial direction relative to a bearing device held on both sides of the friction wheel on a main frame, wherein the relative displacement of the drive shaft on at least one cantilever arm along a guide arrangement arranged or formed on the at least one cantilever arm is carried out in a parallel direction with respect to the drive axis of the drive shaft at least until the friction wheel can be removed from the drive shaft,
- removal of the friction wheel to be changed and arranging another friction wheel between the two bearing devices,
- adjusting back the drive shaft and coupling the drive shaft to the clutch of the drive unit,
- arranging the at least two support elements of the support device on the drive shaft in a form-fit engagement with the drive shaft,
- applying the axial tensioning force between the friction wheel and the drive shaft by means of the tensioning device.

The advantage of this procedure for changing the friction wheel is that it is not necessary to move the entire first bearing device away from the main frame, but that the two bearing devices can remain on the main frame for the friction wheel change. By providing the split-designed support device with at least two support elements, it is possible to arrange it safely on the drive shaft and, above all, with minimum space requirements, and to remove and dismantle it easily. The support elements are preferably designed as half shells and thus embrace the drive shaft. This allows the drive shaft to be disengaged from its coupling connection with the drive unit after removing the support device without any further significant rotational movement and to be pulled out of the second bearing device in the axial direction until the friction wheel is released.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
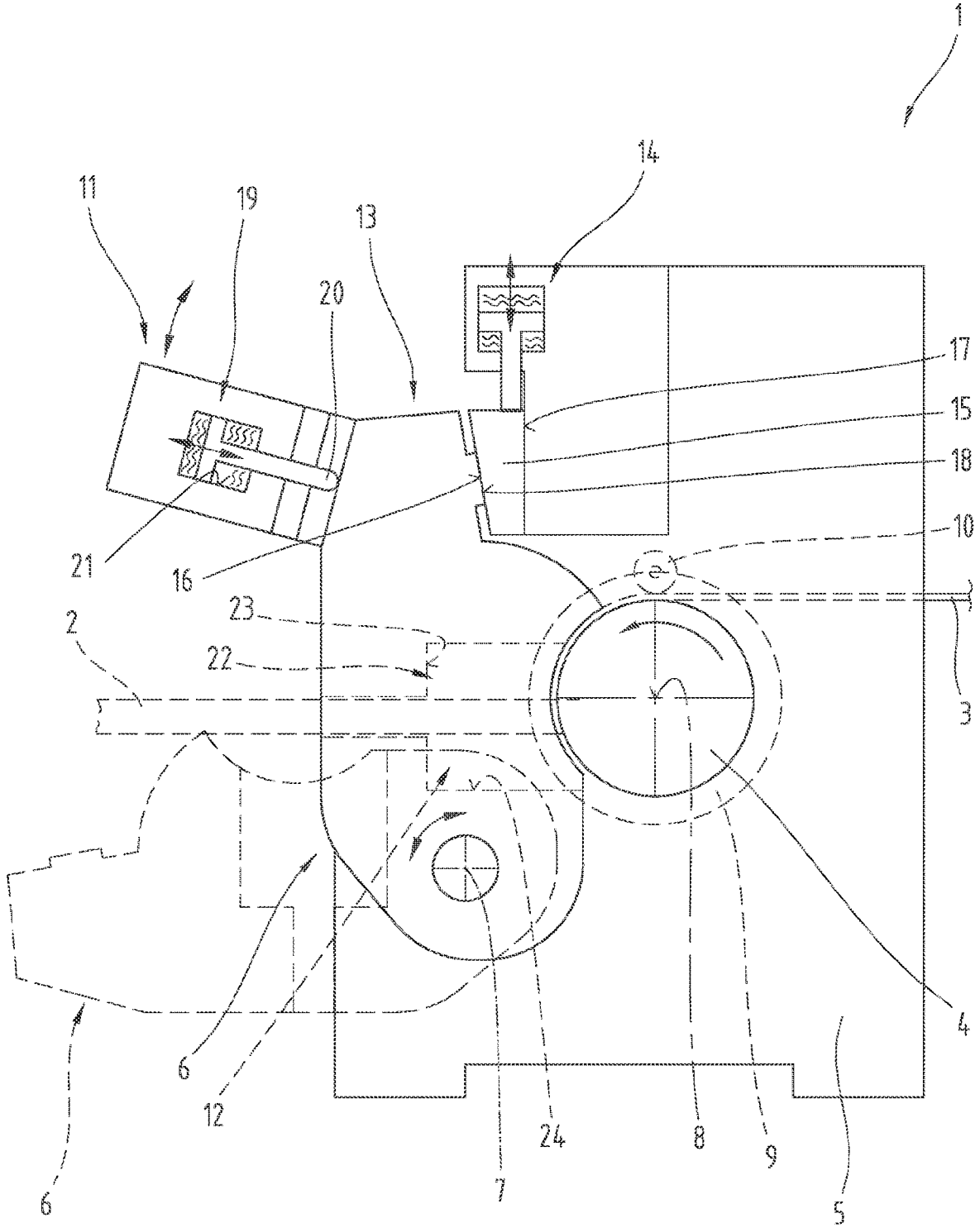
FIG. 1 shows a basic configuration of an extrusion machine according to the known state of the art, in side view as well as simplified stylized representation.

As an introduction, it should be noted that in the differently described embodiments, identical parts are provided with the same reference characters or the same component designations, whereby the disclosures contained in the entire description can be transferred analogously to identical parts with the same reference characters or the same component designations. The positional information selected in the description, e.g. top, bottom, side, etc., are also related to the figure described and shown directly and must be transferred to the new position when the position is changed.

The term "in particular" is understood in the following to mean that it may be a possible more specific embodiment or specification of an object or a procedural step, but does not necessarily have to be a mandatory, preferred embodiment of the same or a mandatory procedure.

FIG. 1 shows a highly stylized representation of an extrusion machine 1, which is used for the manufacture of profiles 2 from a mouldable extrusion material 3.

This extrusion machine 1 shown here is a special form of an extrusion machine 1, which enables a continuous manufacture of profiles 2. For example, a continuously fed wire with a diameter of between 5 and 30 mm is fed as extrusion material 3 to extrusion machine 1, where it is heated by a driven friction wheel 4 to up to 500° C. and above, depending on the material to be moulded. The then doughy material is pressed through a die positioned immediately after the friction wheel 4, with the moulding process taking place in this portion. This continuous process is mainly used for profiles 2 of small and medium dimensions. A wide variety of materials, such as aluminium, copper, non-ferrous metals or their alloys can be formed. The moulding process that can be carried out continuously over a longer period of time with this extrusion machine 1 and the fact that a single, relatively small and simply constructed extrusion machine 1 is required for this purpose, make it possible to reduce costs compared to conventional extrusion machines.

The extrusion machine 1 can basically comprise a main frame 5 as well as a tool holding device 6, which is pivotally or rotatable mounted on a pivot axis 7 held on the main frame 5. The pivot movement is illustrated in simplified form with a double arrow in the area of the pivot axis 7. This allows the tool holding device 6 to be pivoted between a working position and a release position as required. For the sake of clarity, the presentation of pivot actuators or adjustment mechanisms has been omitted, although it should be noted that all devices or elements known from the state of the art can be used here.

Furthermore, the tool holding device 6 is arranged downstream of the friction wheel 4, as viewed in in the pass-through direction of the profile 2 to be manufactured. The working position is indicated here in solid lines and the release position in dashed lines.

The friction wheel 4 can be rotated in the known manner around a drive shaft 8 and is also in drive connection with a drive device 9, which is only indicated schematically. In the present embodiment example, the drive shaft 8 is formed by a continuously formed drive shaft and represents a component of a drive unit 45. The drive unit 45 is also shown and described in FIG. 6 with the schematically simplified main frame 5 and other machine components. In addition, the at least one friction wheel 4 provided also has at least one peripheral groove. Furthermore, at least one pressure roller 10 can be assigned to the friction wheel(s) 4, with which the extrusion material 3 entering the extrusion machine 1 and to be moulded is pressed in radial direction against the friction wheel(s) 4.

The extrusion machine 1 also includes a locking device 11, which is also pivotally supported on the main frame 5. The locking device 11 serves to keep the tool holding device 6, during its working position and operation, positioned relative to the main frame 5, in particular the friction wheel 4. A double arrow in the area of the locking device 11 schematically shows the displacement possibility of the locking device 11.

In FIG. 1 the locking position for the tool holding device 6 is shown in full lines. For the sake of clarity, we have also omitted the illustration of their mount on the main frame 5 as well as the necessary adjustment mechanisms. For example, the locking device 11 can be formed by an approximately U-shaped holding frame, in which the two holding arms are pivotally supported on the side of the main frame 5. A base arm connecting the two holding arms on the outside, for example, grips the tool holding device 6 in the locking position and prevents the tool holding device 6 from pivoting away from its working position. Furthermore, at least one tool unit 12, which is only indicated here schematically, is usually supported on the tool holding device 6, whereby a possible design and support of the tool unit 12 is described in more detail in one of the following figures.

In a known manner, when the extrusion machine 1 is in operation and thereby the tool holding device 6 is in the working position, a gap is formed between the tool unit 12 and the friction wheel 4 in order to avoid collisions and associated mechanical damage.

Since the gap width of the gap between the friction wheel 4 and the tool unit 12 is dependent on the one hand on the temperature of the plant components and on the other hand on wear and tear of the tool unit 12, a rather exact and above all readjustable setting of the gap width of the gap can be a separate aspect in the present invention. Thus, the maintenance and adjustment of the gap width can represent an object of the invention independent of the invention itself, and in the same way can also represent a solution independent of the other plant components and process steps described here.

Thus, in this embodiment example shown here, in addition to the locking device 11 on the main frame 5, a separate adjusting device 14 is arranged in an end area 13 of the tool holding device 6, which is distanced from the pivot axis 7 and opposite the drive axis 8 of the friction wheel 4. The adjusting device 14 has an adjustably designed adjusting element 15 which is adjustable relative to the main frame 5. The adjusting element 15, in turn, has a adjusting surface 16 facing the end area 13 of the tool holding device 6 and a guide surface 17 facing away from the tool holding device 6.

As can be seen in the schematic diagram of the adjusting element 15, the adjusting surface 16 and the guide surface 17 are aligned in a wedge shape. The guide surface 17 is supported on an unspecified portion of the main frame 5, which is especially designed as a sliding surface. The adjusting element 15 is also connected to an unspecified adjusting mechanism and can be adjusted in the direction of a schematically marked double arrow relative to the main frame 5.

The guide surface 17 and the portion of the main frame 5, which is designed as a sliding surface, have a vertical or perpendicular alignment. The tapered wedge shape is oriented towards a support surface of extrusion machine 1 and thus also towards the pivot axis 7 which is located close to the floor. Thus the inclined adjusting surface 16 runs from top left to bottom right, as can be seen from the side view of extrusion machine 1.

The tool holding device 6 has a support surface 18 at its end area 13, which is distanced from the pivot axis 7, and on a first side facing the friction wheel 4. When the tool holding device 6 is in the working position, the support surface 18 arranged or formed on the tool holding device 6 is supported on the adjusting surface 16 of the adjusting element 15.

The locking device 11 described above also has at least one pressure unit 19 with at least one pressure element 20. Here, with the tool holding device 6 in the working position, the pressure element 20 is also located in the end area 13 distanced from the pivot axis 7, but is in contact with the tool holding device 6 on a second side facing away from the friction wheel 4. In addition, the pressure unit 19 is used to press the support surface 18 of the tool holding device 6 against the adjusting surface 16 of the adjusting element 15. Since the adjusting element 15 is also supported with its guide surface 17 on the main frame 5, when the adjusting element 15 is displaced relative to the main frame 5 by means of the adjusting device 14, the tool holding device 6 can be adjusted, in particular pivoted, about its pivot axis 7 due to the wedge-shaped, in particular acute-angled, mutually aligned adjusting surface 16 and guide surface 17. Since the tool holding device 6 corresponds in the broadest sense to a lever or lever arrangement, the gap formed between the tool unit 12 and the friction wheel 4 can also be changed in its gap width as a result of the adjustment of the adjusting element. The determination and adjustment of the gap width will be described in more detail below.

Furthermore, in the area of the locking device 11, it is shown in simplified form that the pressure element 20 of the pressure unit 19 is accommodated at least in some areas in a pressure chamber 21 and is thereby acted upon by a pressure medium which is indicated in simplified form by lines and is located in the pressure chamber 21. The pressure medium can be liquid or gaseous, whereby an almost incompressible fluid, such as hydraulic oil, has proven to be favourable, especially at high pressures. The pressure element 20 can, for example, be designed as a double-acting piston with a piston rod of a cylinder-piston arrangement, whereby, when appropriately loaded, the pressure element 20 is then pressed against the second side of the tool holding device 6, facing away from the support surface 18.

By pressing the end portion 13 with its support surface 18 against the adjusting element 15, an exactly defined position of the tool unit 12, which is accommodated and held in position in the tool holding device 6, relative to the friction wheel 4 is achieved due to the mounting of the tool holding device 6 about the pivot axis 7. By the corresponding adjusting movement of the adjusting device 14 with its wedge-shaped surfaces, namely the adjusting surface 16 and the guide surface 17, a corresponding displacement of the tool holding device 6 about the pivot axis 7 is achieved.

If the adjusting element 15 of the adjusting device 14 is adjusted, not only is the relative position of the tool holding device 6 with respect to the main frame 5, in particular the friction wheel 4, shifted, but there is also a change in volume of the pressure medium accommodated in the pressure chamber, which causes the pressure element 20 to be adjusted in its relative position with respect to the pressure unit 19. To enable this compensation in the pressure system, relief valves can be used to avoid a rigid system and to allow the pressure element 20 to be adjusted. The pressure force built up by the pressure unit 19 remains unchanged within certain limits and thus keeps the tool holding device 6 together with the tool unit 12 held in it in the working position.

Depending on whether there is a relative displacement of the pressure element 20 in the direction towards the friction wheel 4 or in the opposite direction, the pressure medium in the pressure chamber 21 is automatically balanced. This allows the tool holding device 6 to be pivoted in its relative position both in the direction towards the friction wheel 4 and in the opposite direction. The permanent holding and locking of the tool holding device 6 in its end area 13 is maintained unchanged by the locking device 11 and the support surface 18 of the tool holding device 6 is always in firm abutment against the adjusting surface 16 of the adjusting element 15. The adjusting element 15 is, as already described above, supported by its guide surface 17 on the main frame 5, preferably sliding and, if necessary, guided.

Furthermore, it is shown here that an accommodation chamber 22 is formed or arranged in the tool holding device 6. The outlines of the holding chamber 22 are only shown in simplified form, whereby the tool unit 12 is held in this chamber. To support the tool unit 12, the accommodation chamber 22 has at least two first and second positioning surfaces 23, 24, which are aligned at an angle, in particular at right angle, to each other and on which the tool unit 12 is supported. With the tool holding device 6 in the working position, the first positioning surface 23 is arranged on the side of the tool unit 12 facing away from the friction wheel 4 in this shown embodiment example. It is also shown that the accommodation chamber 22 is open in the direction towards the friction wheel 4. Thus, in the working position of the tool holding device 6, the first positioning surface 23 can be aligned approximately vertically as well as vertically with respect to the direction of passage of profile 2.

Figure 2:
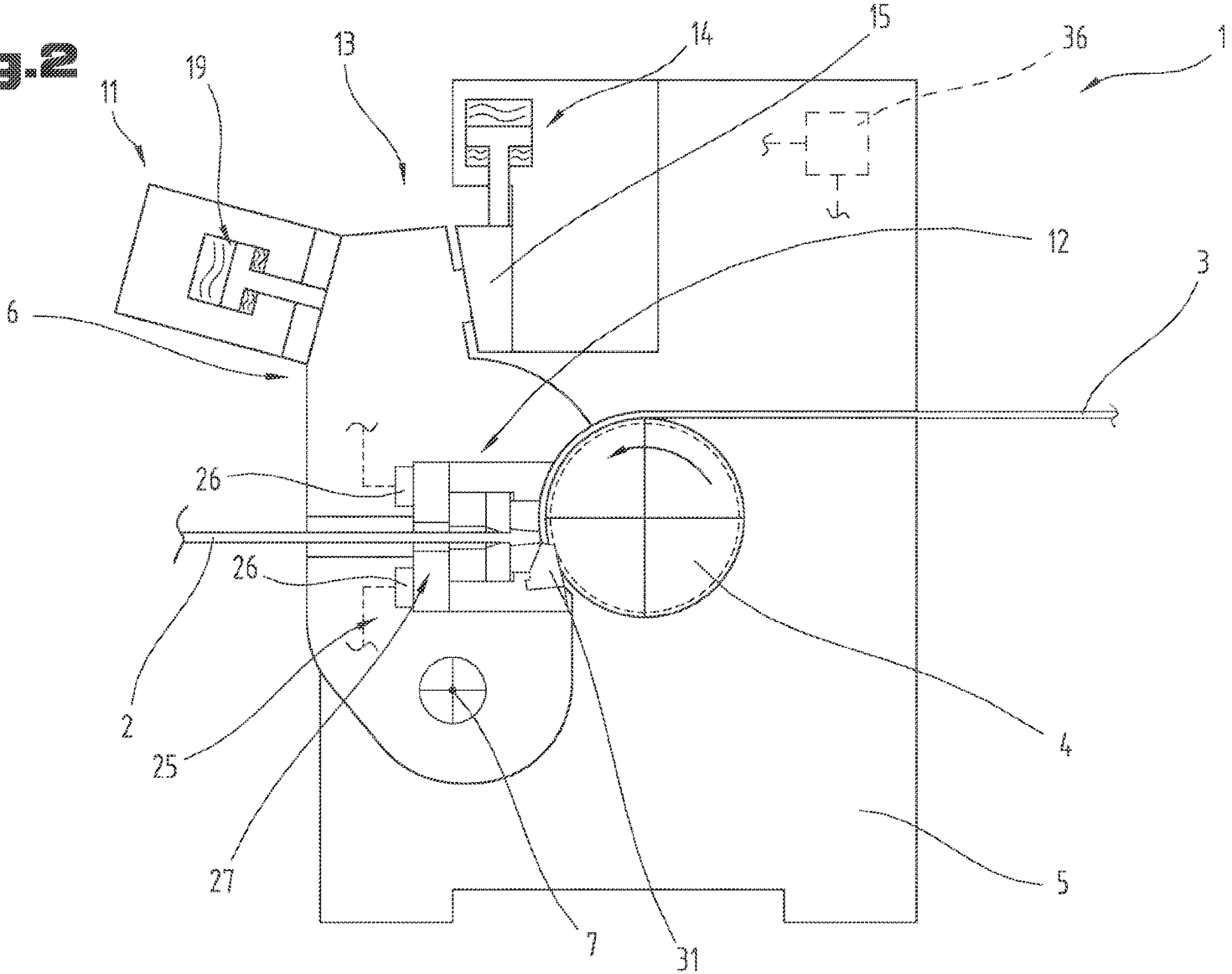
FIG. 2 shows the extrusion machine with a sensor unit arranged in the area of the tool holding device for the tool unit held therein, in side view and simplified stylized representation.

FIG. 2 shows a simplified representation of the extrusion machine 1 with the tool unit 12 accommodated and supported in the tool holding device 6, although this may represent an independent embodiment. Again, the same reference marks or component designations as in the previous FIG. 1 are used for identical parts. In order to avoid unnecessary repetition, reference is made to the detailed description in the previous FIG. 1. The basic configuration can be analogous, as described above.

In the exit area of the profile 2 from the tool unit 12, the latter is supported on the tool holding device 6 with the interposition of a first sensor unit 25, in particular a force measuring sensor or several force measuring sensors, adjacent to the first positioning surface 23. The first sensor unit 25 can be formed by pressure sensors, quartz sensors, load cells or similar. Preferably several sensors 26 are used to form the first sensor unit 25 in order to achieve an even and mostly symmetrical support of the tool unit 12 on the tool holding device 6 in the area of its first positioning surface 23. Preferably, four pieces of sensors 26 can be provided.

Furthermore, it is also possible that a separate temperature control element 27 is arranged or formed between the tool unit 12 and the tool holding device 6. The temperature control element 27 can, for example, be designed as a separate cooling plate and serves to minimize or prevent direct heat transfer from the tool unit 12 to the first sensor unit 25. The temperature control element 27 can also represent or form a component or assembly unit of tool unit 12. For the sake of clarity, the presentation of supply lines for the transport of the temperature control medium, in particular a cooling medium, or similar, has been omitted.

The sensor unit 25 with its sensors 26 is also in communication connection with a control and/or regulating device 36. This can be done via cables or wirelessly. Simplified, a line connection between the sensors 26 and the control and/or regulating device 36 is indicated.

By means of the first sensor unit 25, the moulding force occurring under normal operating conditions can be determined by determining a minimum initial distance and converting it to the compression forces occurring. The usual operating conditions are operating parameters defined by the machine manufacturer, under which the moulding force occurring is determined. The moulding force may depend on the extrusion material 3 fed and intended for moulding and the profile 2 formed from it.

Under normal operating conditions, for example, the revolutions of the friction wheel 4 per unit of time, the moulded mass of extrusion material 3 per unit of time, and other machine parameters or operating parameters are considered which have been determined beforehand by the machine manufacturer and which have been defined for the respective machine type within certain limits with a lower limit value and an upper limit value. Within these limits, extrusion machine 1 is in a standard operating condition. If, for example, a deviation of the determined moulding force above the upper limit value has been detected, this can lead to an overload of the extrusion machine 1 and subsequently to a damage of the same.

Overloading and the associated increase in the compression forces that occur could occur, for example, if the number of revolutions of friction wheel 4 per time unit is increased and/or the associated mass throughput of material to be moulded per time unit is increased. In order to avoid overloading of the extrusion machine 1 and a subsequent damage of the same, the revolutions of friction wheel 4 per time unit or other operating parameters can be reduced by means of a machine control system not shown in detail. By detecting and determining the moulding force built up, this can be stored in a memory and subsequently provide the machine manufacturer or another operator with clear and unambiguous evidence of a machine overload. This is especially the case when it comes to providing evidence in the event of repairs and about the causer of damage.

Figure 3:
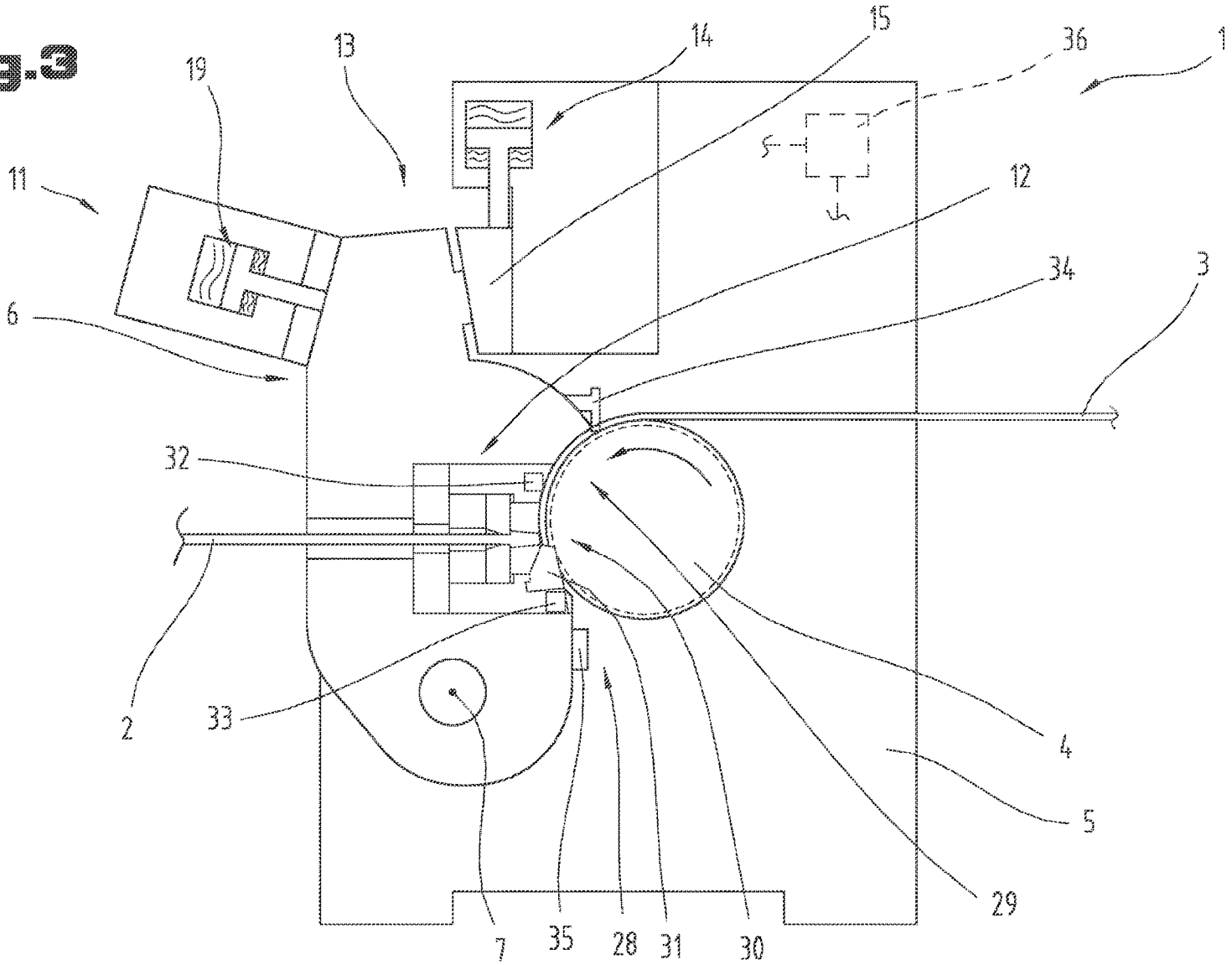
FIG. 3 shows the extrusion machine with a shielding device arranged in the moulding area, in side view and simplified stylized representation.

FIG. 3 shows a simplified representation of the extrusion machine 1 with the tool unit 12 accommodated and supported in the tool holding device 6, whereby this in turn may represent an independent embodiment. Again, the same reference marks or component designations as in the previous FIGS. 1 and 2 are used for identical parts. In order to avoid unnecessary repetition, reference is made to the detailed description in the preceding FIGS. 1 and 2.

The material to be moulded, especially if it is pure copper or a copper alloy, is always manufactured without oxygen. In the usual moulding process, the heated material absorbs oxygen from the ambient air, especially in or under the outer skin or outer layer of the manufactured profile 2.

In order to minimise or completely prevent access of ambient air, especially oxygen, to the heated and to be moulded material, a shielding unit 28 is indicated here in simplified form in the working area of friction wheel 4. This is intended to minimise or completely prevent oxidation or oxygen absorption. The shielding unit 28 usually comprises several component parts and extends over a peripheral portion 29 of the friction wheel 4, in which at least partial heating of the extrusion material 3 to be moulded begins and is continued up to a stripping area 30. The stripping area 30 is located at tool unit 12, whereby the deflection and stripping of the heated material is carried out in a known manner by a part of the tool unit 12, in the present embodiment example by a stripping element 31. The access of ambient air should also be minimized or completely prevented in the stripping area 30 of the heated and to be moulded extrusion material 3.

In the case of shielding unit 28, for example, it is intended that an atmosphere is created within the area described above, in which the material is already in a heated state, which prevents oxidation or oxygen absorption.

For this purpose, a gas which is free of gaseous oxygen can be supplied by means of one or more first nozzles 32, which are preferably arranged or designed in the area of the tool holding device 6, in particular in the vicinity of its accommodation chamber 22. This gas can also be an inert gas and may be formed by nitrogen and/or noble gases, for example. Noble gases include, for example, helium, neon and argon. However, inert gases such as those used in welding technology would also be possible. The presentation of supply conduits, shut-off devices or the like has been omitted for the sake of clarity. The first nozzle 32 or the first nozzles 32 is/are facing the peripheral portion 29 of the friction wheel 4 and is/are located above the scraper element 31, so that it would also be possible to arrange or form the first nozzle 32 or the first nozzles 32 in or on the tool unit 12.

In order to also prevent access of ambient air from the underside and the area below the scraper element 31, one or more second nozzles 33 may be arranged or formed in this area as well. The second nozzle 33 or the second nozzles 33 is/are arranged in the direction of rotation of the friction wheel 4, downstream of the peripheral portion 29 of the friction wheel 4 and may also face the latter. Preferably the second nozzles 33 are arranged or designed below the scraper element 31. So it would again be possible to arrange or design the second nozzle 33 or the second nozzles 33 in or on the tool unit 12. Nozzles 32, 33 are preferably supplied with the same gas and can form the low-oxygen or oxygen-free atmosphere in the heated area of the extrusion material 3 to be moulded with the outflowing gas.

It may also be provided that the shielding unit 28 comprises a butterfly valve 34 in the first contact area of the extrusion material 3 and thus in the feed area of the extrusion material to the friction wheel 4. On the one hand, this can prevent the inflow of ambient air into the area to be shielded and, on the other hand, create a certain barrier against the outflow of the supplied gas. Thus, the machine room surrounding the heated material inside the extrusion machine 1 can be shielded against the unwanted access of ambient air. Preferably, the supplied gas, which can also be called protective gas, is fed into this shielding area at a slightly higher pressure than the ambient pressure in order to ensure that the supplied gas flows away.

Furthermore, it is also shown that an access of ambient air to the second nozzle(s) 33 located below the scraper element 31 can also be minimized or completely prevented by a gas curtain flowing out or formed by a further nozzle arrangement 35. The gas fed in and flowing out here can also be a gas which is free of gaseous oxygen as described above. But a different gas could also be used. Depending on the direction of the outflow, ambient air could also be used.

It should be mentioned that the nozzle or nozzles 32, 33 and/or the further nozzle arrangement 35 have only been indicated schematically. These are in flow connection with a supply unit (not shown in detail) or a storage unit via a line connection.

The extrusion machine 1 basically comprises several tool components, of which, for example, a first tool component can form the friction wheel 4 and a second tool component can form the tool unit 12.

Figure 4:
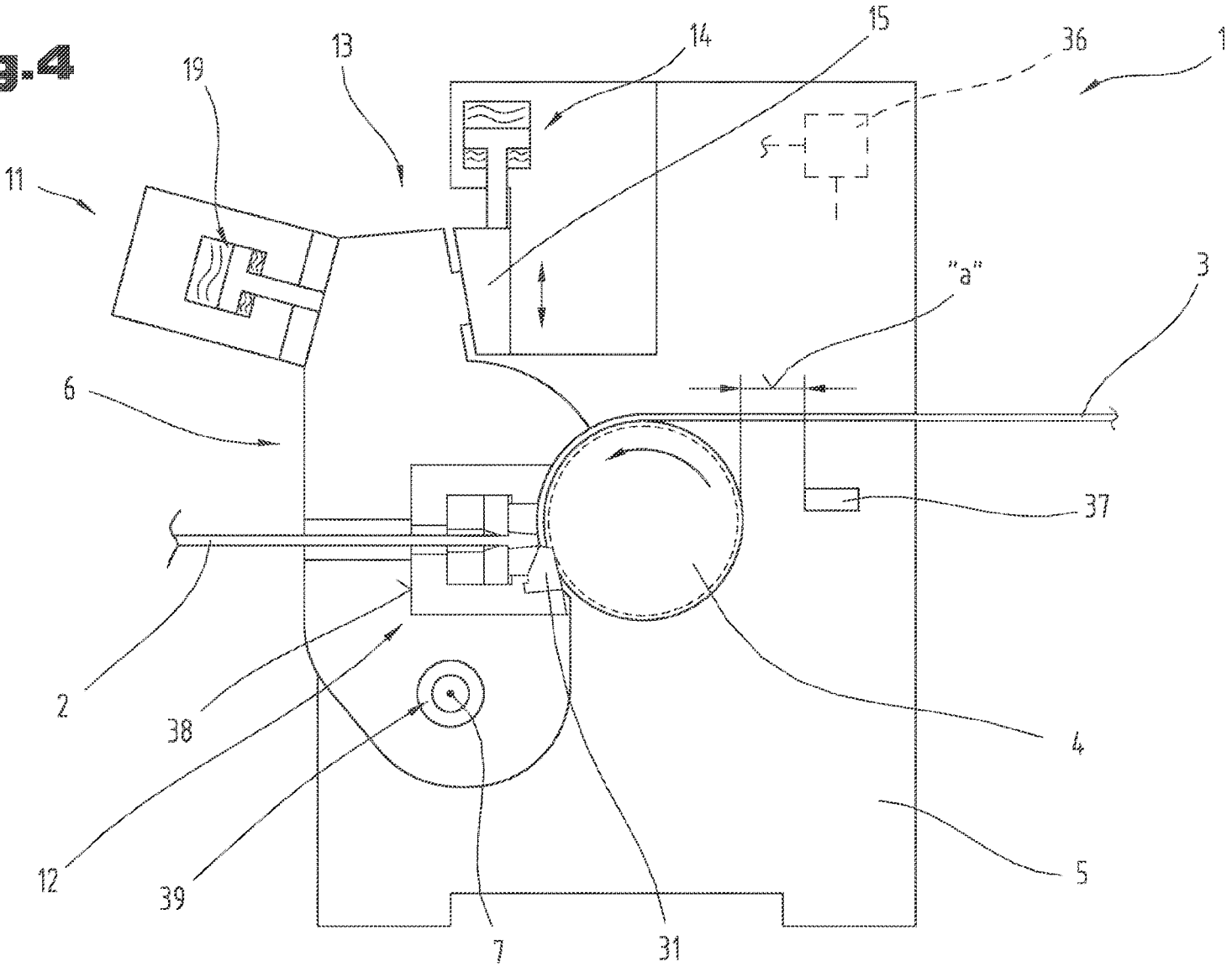
FIG. 4 shows the extrusion machine with a distance control device for adjusting the gap between the friction wheel and the tool unit, in side view and simplified stylised representation.

FIG. 4 shows a simplified representation of the extrusion machine 1 with the tool unit 12 with the stripping element 31, which is accommodated and supported in the tool holding device 6, whereby this in turn may represent an independent embodiment. Again, the same reference marks or component designations as in the preceding FIGS. 1 to 3 are used for identical parts. In order to avoid unnecessary repetition, reference is made to the detailed description in the preceding FIGS. 1 to 3.

The extrusion machine 1 comprises at least the main frame 5 with the tool holding device 6 which is supported so as to be pivotable about the pivot axis 7. The friction wheel 4 is used for friction-based heating of the extrusion material to be moulded 3. The locking device 11 is used to hold the tool holding device 6 in position relative to the main frame 5, in particular the friction wheel 4, during its working position and operation.

The setting, adjustment and/or readjustment of a gap width of a gap between a first tool component and at least one further tool component is described in the following process steps for such an extrusion machine 1. In the embodiment example presented here, the first tool component is formed by the friction wheel 4 and the second or further tool component is formed by the tool unit 12, which is accommodated in a tool holding device 6 and held in position in the tool holding device 6, with at least the stripping element 31 facing the friction wheel 4. For this reason, specific reference is made to these designations in the following.

First, a first distance value between the friction wheel 4 and a distance measuring device 37 is determined or geometrically set in advance. This is entered with "a" in FIG. 4. The first distance value is or will be stored or saved in the control and/or regulating device 36. The tool unit 12 is then moved closer to the still stationary friction wheel 4 and advanced until the scraper element 31 comes into abutment with the friction wheel 4, particularly in the bottom of the groove. In the control and/or regulating device 36 a first adjustment travel is also stored, the value of which corresponds to a base gap width to be set.

Then the tool unit 12 in abutment with the friction wheel 4 is displaced by the first adjustment travel stored in the control and/or regulating device 36, whereby the gap between the friction wheel 4 and the tool unit 12 is or will be formed then with the base gap width. If this has been done correctly, extrusion machine 1 can be started up and the moulding process of extrusion 3 to profile 2 can be carried out. Due to the moulding process and the frictional heat generated by it, temperature-related dimensional changes occur in components of extrusion machine 1, in particular friction wheel 4.

By means of the distance measuring device 37, further distance values between the friction wheel 4 and the distance measuring device 37 are repeatedly determined and recorded. Due to the increase in temperature of the friction wheel 4, its diameter becomes larger than in its "cold" initial state. This allows a distance difference value to be moulded from the first distance value minus one of the other distance values. Based on these values a calculation of an actual value of a gap width between the friction wheel 4 and the tool unit 12 can be carried out. The distance difference value is subtracted from the value of the base gap width, which corresponds to that of the first adjustment travel, and thus the actual value of a gap width between the friction wheel 4 and the tool unit 12, in particular its stripping element 31, is calculated.

Furthermore, a value range with a lower target value of the gap width and an upper target value of the gap width can be or is stored in the control and/or regulating device 36. Based on the calculated actual value of the gap width, a check is now made to see whether the calculated actual value is within the limits of the lower target and the upper target of the value range. If the gap width falls below the lower target value, the tool unit 12 must be moved to the side or direction away from the friction wheel 4 by a correction value stored in the control and/or regulating device 36. If the upper target value of the gap width is exceeded, the tool unit 12 must be displaced or adjusted in the direction towards the friction wheel 4.

The displacement or adjustment of the tool holding device 6 together with the tool unit 12 can be carried out by means of the adjusting device 14 described above in cooperation with the locking device 11 and the pressure unit 19. These adjustment movements can also be called tracking steps. This adjustment movement and readjustment can be carried out during operation under full load. This has the advantage that it is not necessary to stop the machine, but that a gap width change can be carried out directly and immediately. This can be done with the previously described adjusting element 15 of the adjusting device 14, designed as an adjusting wedge.

The determination of the first distance value should be carried out in the so-called "cold state" of friction wheel 4, especially at an initial temperature of the same in a temperature range between 10° C. and 40° C.

Based on the distance measurement carried out, a change in diameter of friction wheel 4 can also be calculated and determined. Basically, the geometry, in particular the diameter(s) of friction wheel 4, is known from the embodiment and manufacture, which serves as the measuring surface for determining the distance. This means that the actual value of the gap width between the two tool components can also be determined in an analogous manner via the thermal increase in diameter dimension.

Since different profile geometries can be manufactured depending on the tool unit 12 used in each case, all tool units 12 used in the present extrusion machine 1, in particular in its tool holding device 6, are formed with the same longitudinal dimensions to each other in their longitudinal extension, starting from the stripping element 31 up to a tool end face 38 arranged at a distance from it, as viewed in the pass-through direction of the profile 2 to be manufactured. The tool end face 38 is located on the side facing away from the friction wheel 4 and is supported on the tool holding device 6 in the area of the first positioning face 23, if necessary with the interposition of the sensor unit 25, which is not shown in detail here.

Based on this design, the respective relative angular position of the tool holding device 6 with respect to the physical pivot axis 7 and/or with respect to the main frame 5 can be determined and established in the area of the pivot axis 7, e.g. by means of a rotary encoder or another sensor 39 detecting a pivot angle. However, the respective relative angular position between the physical pivot axis 7 and the main frame 5 could also be determined if the physical pivot axis 7 is firmly connected to the tool holding device 6.

Thus, for example, a basic angular position of the tool holding device 6 with respect to the main frame 5 can be determined when the tool unit 12, in particular its stripping element 31, is in abutment with the friction wheel 4 and can be stored in the control and/or regulating device 36. If the previously described basic gap width has been set, at which the tool holding device 6 is displaced away from the friction wheel 4, a target angular position of the tool holding device 6 can be determined and stored in the control and/or regulating device 36.

The previously described and stored base angle position can be used to determine the correct position of a changed tool unit 12 in the accommodation chamber 22 even before initial operation and/or before adjusting the base gap width. If, for example, an object is located between the first positioning surface 23 and the tool end surface 38 of the tool unit 12, the latter protrudes further towards the friction wheel 4 than if the object were not present.

This allows the tool holding device 6 together with the tool unit 12 to be pivoted from its release position towards the working position for as long as necessary after a tool change has been carried out and when the second tool component, in particular tool unit 12, is correctly positioned and the first tool component, in particular the friction wheel 4, is stationary, until the relative basic angular position between the tool holding device 6 and the main frame 5 or the fixed pivot axis 7 is reached and, in doing so, the second tool component, in particular the tool unit 12, is brought into abutment with the first tool component, in particular the friction wheel 4.

If, on the other hand, the object described above is located between the tool unit 12 and the tool holding device 6, an error handling routine can be started by the control and/or regulating device 36 when the second tool component, in particular the tool unit 12, is in abutment with the first tool component, in particular the friction wheel 4, even before the relative basic angular position between the tool holding device 6 and the main frame 5 or the fixed pivot axis 7 is reached. Thus, the machine operator can be informed even before initial operation that there is no proper positioning and that the relative position of the tool unit 12 in the accommodation chamber 22 must be checked and corrected if necessary. This can prevent damage to the extrusion machine 1.

The distance measuring device 37, which can be formed by the most different sensors or measuring equipment, and the sensor or sensors 39 can together form another sensor unit.

Figure 5:
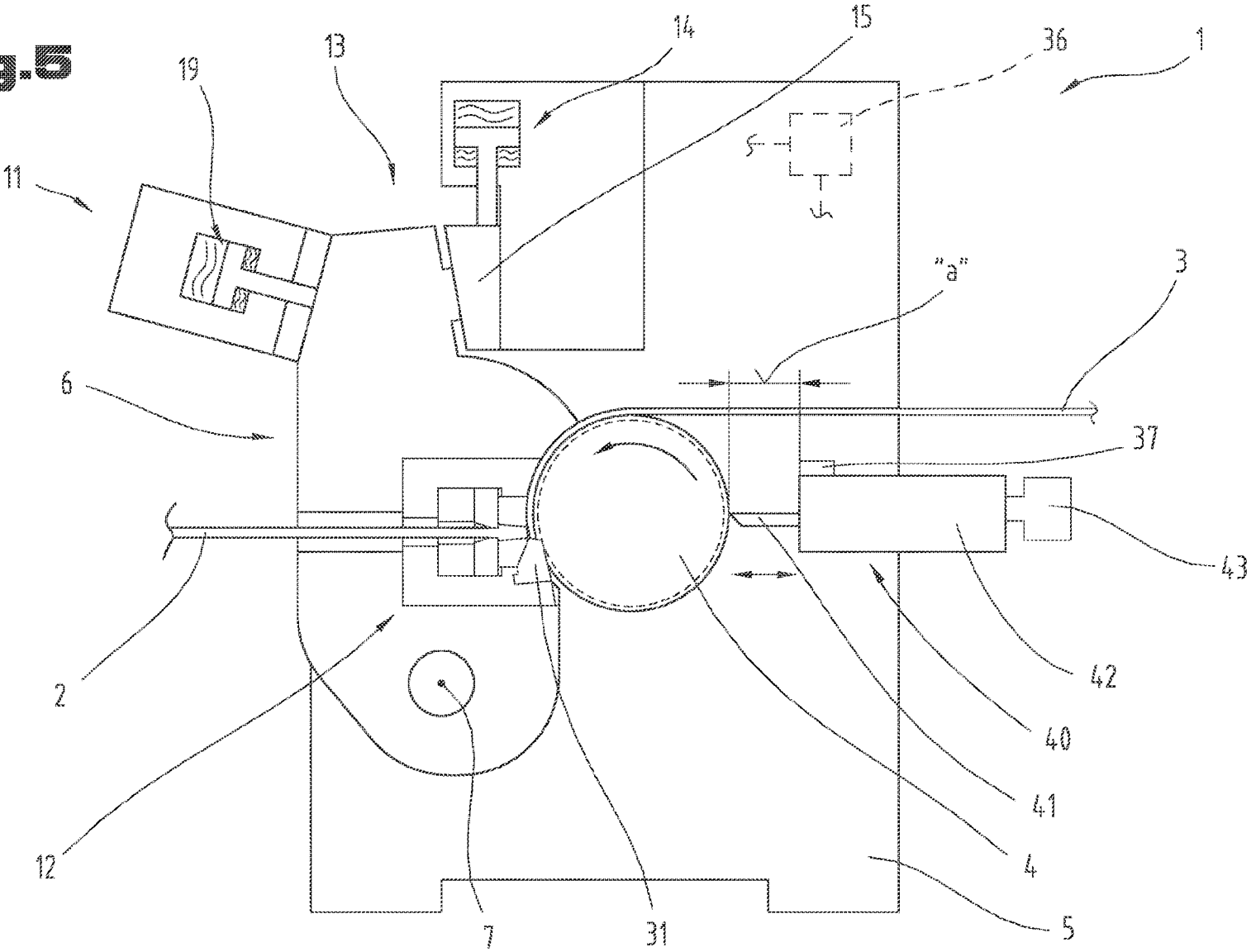
FIG. 5 shows the extrusion machine with a distance control device for adjusting the gap between the friction wheel and a scraping device, in side view and simplified stylised representation.

FIG. 5 shows a simplified representation of the extrusion machine 1 with the tool unit 12 with the stripping element 31, which is accommodated and supported in the tool holding device 6, whereby this in turn may represent an independent design. Again, the same reference marks or component designations as in the preceding FIGS. 1 to 4 are used for identical parts. In order to avoid unnecessary repetition, reference is made to the detailed description in the preceding FIGS. 1 to 4.

The extrusion machine 1 comprises at least the main frame 5 with the tool holding device 6 which is supported so as to be pivotable about the pivot axis 7. The friction wheel 4 is used for friction-based heating of the extrusion material 3 to be moulded. The locking device 11 is used to hold the tool holding device 6 in position relative to the main frame 5, in particular the friction wheel 4, during its working position and operation.

In addition, such extrusion machines 1 are usually designed so that, due to the previously described operating gap between the tool unit 12 and the friction wheel 4, a portion of the extrusion material 3 to be moulded is not stripped off by the friction wheel 4 and is carried along by the latter. To remove or scrape off this material remaining on the friction wheel 4, a scraping device 40 is arranged downstream of tool unit 12, as viewed in the direction of rotation of the friction wheel 4. The scraping device 40 comprises at least one scraping element 41 which is adjustable relative to the friction wheel 4 which is designed here as the first tool component. The at least one scraping element 41 is also to be arranged with a corresponding gap in a position relative to the friction wheel 4 and is to be readjusted during the current moulding operation due to thermal length change. Preferably, the scraper element 41 is held or guided in a basic housing 42 and can be adjusted in its relative position and location in relation to the first tool component by means of an actuator 43.

In this embodiment example, the first tool component is formed by the friction wheel 4 and the second or further tool component by the scraping device 40 with the scraping element 41. For this reason, specific reference is made to these designations in the following. For the sake of clarity, no adjustment means for the scraper device 40 and/or the at least one scraper element 41 have been shown.

First, a first distance value between the friction wheel 4 and the distance measuring device 37 is determined or geometrically set in advance. This is entered with "a" in FIG. 5. The first distance value is or will be stored or saved in the control and/or regulating device 36. Subsequently, the scraping device 40 and/or the scraping element 41 are moved closer to and abutted against the friction wheel 4, which is still stationary, until the scraping element 41 comes into abutment with the friction wheel 4, especially in the bottom of the groove. In the control and/or regulating device 36 a first adjustment travel is also stored, the value of which corresponds to a base gap width to be set. Here the distance measuring device 37 is arranged or accommodated on or in the basic housing 42. It is also possible to use this distance measuring device 37 described and shown here also for the distance measurement described previously in FIG. 4. For this reason, the same reference sign was also used for the distance measuring device 37.

Then the displacement of the scraping device 40 and/or the scraping element 41, which is in abutment with the friction wheel 4, is effected by the first adjustment travel stored in the control and/or regulating device 36, wherein the gap between the friction wheel 4 and the scraping device 40 and/or the scraping element 41 is or will be formed then with the base gap width. If this has been done correctly, the extrusion machine 1 can be started up and the moulding process of extrusion material 3 to profile 2 can be carried out. Due to the moulding process and the frictional heat generated by it, temperature-related dimensional changes occur in components of the extrusion machine 1, in particular the friction wheel 4.

By means of the distance measuring device 37, further distance values between the friction wheel 4 and the distance measuring device 37 are repeatedly determined and recorded. Due to the increase in temperature of the friction wheel 4, its diameter becomes larger than in its "cold" initial state. This allows a distance difference value to be formed from the first distance value minus one of the other distance values. Based on these values a calculation of an actual value of a gap width between the friction wheel 4 and the scraping device 40 and/or the scraping element 41 can be carried out. The distance difference value is deducted from the value of the base gap width, which corresponds to that of the first adjustment travel, and thus the actual value of a gap width between the friction wheel 4 and the scraping device 40, in particular its scraping element 41, is calculated.

Furthermore, a value range with a lower target value of the gap width and an upper target value of the gap width can be or is stored in the control and/or regulating device 36. Based on the calculated actual value of the gap width, a check is now made to see whether the calculated actual value is within the limits of the lower target and the upper target of the value range. If the gap width falls below the lower target value, the tool unit 12 must be moved to the side or direction away from the friction wheel 4 by a correction value stored in the control and/or regulating device 36. If the upper target value of the gap width is exceeded, the scraping device 40 and/or the scraping element 41 must be moved towards the friction wheel 4. These adjustment movements can also be called tracking steps.

The determination of the first distance value should also be carried out here in the so-called "cold state" of friction wheel 4, especially at an initial temperature of the same in a temperature range between 10° C. and 40° C.

Figure 6:
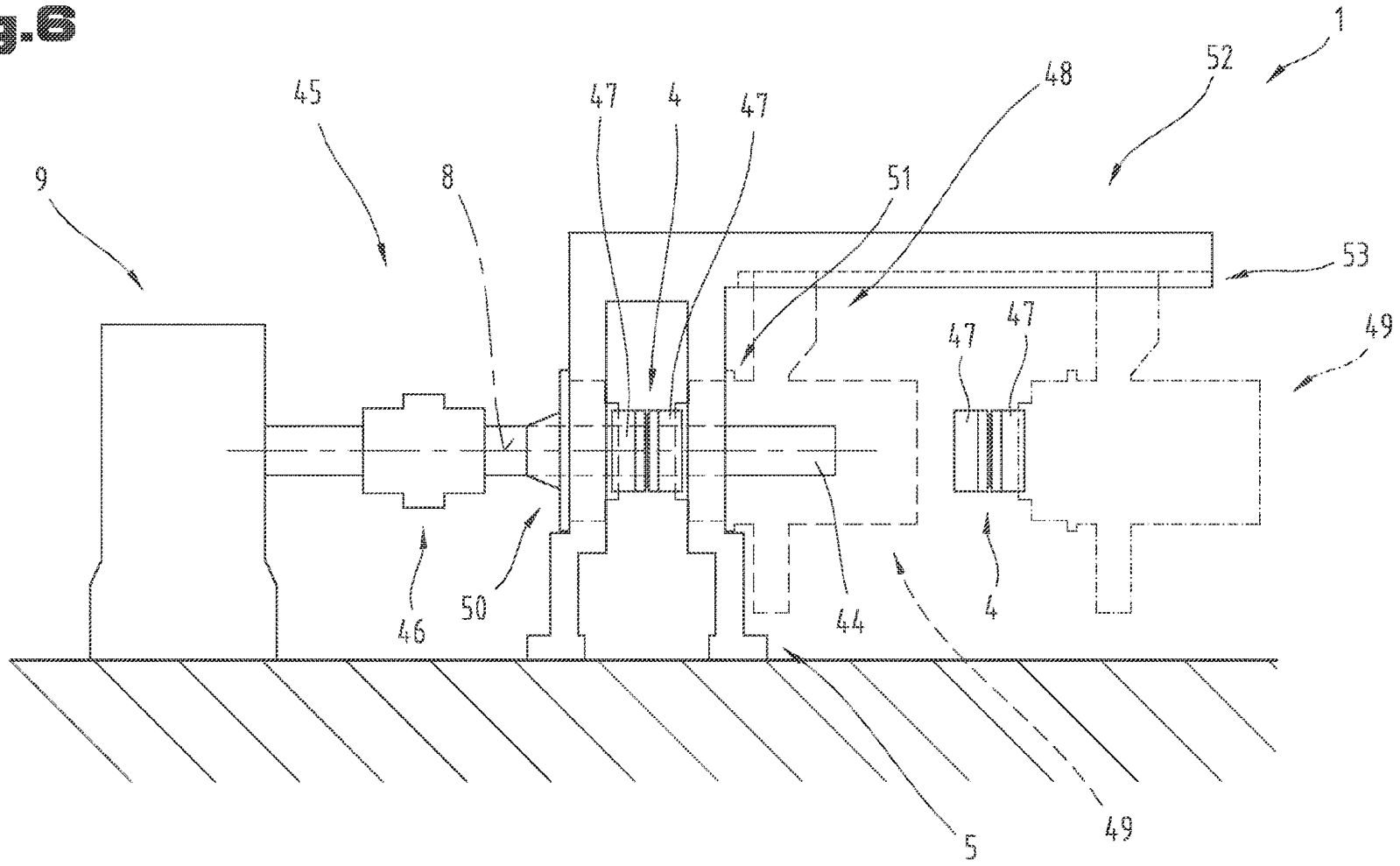
FIG. 6 shows another possible embodiment of an extrusion machine with a device for changing the friction wheel, in frontal view and highly stylised representation.

FIG. 6 shows a simplified front view of the extrusion machine 1 with its main frame 5 and the drive unit 45 for the friction wheel 4. For the sake of clarity, the tool holding device 6, the locking device 11 and the tool unit 12 have been omitted for the sake of clarity, whereby the extrusion machine 1 can be of the same embodiment as described above in FIGS. 1 to 5. Individual or all of the machine components described above can also be used with this extrusion machine 1.

The drive unit 45 comprises at least the drive device 9, the drive shaft 44 defining the drive shaft 8 and, if necessary, a clutch 46. The at least one friction wheel 4 is drivingly connected to the drive device 9. On either side of friction wheel 4, a driving ring 47 may be provided, by means of which the drive torque can be transmitted from the driving device 9 to the friction wheel 4. The drive shaft 44 is rotatable mounted on the main frame 5 by means of a bearing unit 48, comprising a first bearing device 49 and a second bearing device 50. The bearing devices 49, 50 may not only comprise their bearing arrangements but also housings, guide means, fasteners or the like and each represents a separate component. The at least one friction wheel 4 may be retained on the first bearing device 49, if necessary by means of a driving ring 47.

In the present embodiment example it is still provided that a coupling device 51 is provided between the first bearing device 49 and the main frame 5. The coupling device 51 could also be called coupling device and is used to detachably couple or connect the entire first bearing device 49 to the main frame 5. For this purpose the coupling device 51 can be moved from its coupling position to a decoupling position. For the sake of clarity, the representation of actuating means for actuating the coupling device 51, such as cylinders, actuators or the like, has also been omitted. The first bearing device 49 is shown in two different positions. In the first position—shown in dotted lines—the coupling position on the main frame 5 is shown, in which the drive shaft 44 is also supported by the first bearing device 49 on the main frame 5. The decoupled position and the position shifted or displaced away from the main frame 5 are shown in dotted lines. One possibility of guided adjustment is described below.

Furthermore, the extrusion machine 1 also includes at least one cantilever arm 52, which is arranged or designed to extend in a parallel direction with respect to the drive axis 8. In the present embodiment example, the at least one cantilever arm 52 is arranged vertically above the drive shaft 44 and at a distance from it. However, the cantilever arm 52 could also be arranged at bottom side and thus below the drive shaft 44. The cantilever arm 52 can also be connected or attached to the main frame 5. The cantilever arm 52 can also be arranged or designed to extend from the main frame 5 to the side facing away from the drive unit 9.

In the case of an arrangement above the drive shaft 44, the first bearing device 49 can be held in a suspended arrangement guided by at least one cantilever arm 52. A guide arrangement 53 may be provided for this purpose, which is arranged or formed on at least one cantilever arm 52. Thus, when the coupling device 51 is in the decoupling position, the first bearing device 49 can be adjustably guided along the cantilever arm 52 by means of the guide arrangement 53, whereby the entire first bearing device 49 together with the friction wheel 4 and, if necessary, the driving rings 47 can be moved away from the main frame 5. The second bearing device 50 together with the drive shaft 44 supported thereon remains stationary on the main frame 5 during a friction wheel change operation to be carried out. When changing or exchanging the friction wheel 4 is carried out, after uncoupling the coupling device 51 (moving the coupling device 51 from its coupling position to its uncoupling position), it can be moved away from the main frame 5 and thus be pulled off the drive shaft 44.

The procedure for changing friction wheel 4 may include at least those steps:

decoupling the coupling device (51) located between the first bearing device (49) and the main frame (5) of the extrusion machine (1) and thereby displacing it from its coupling position into its decoupling position, relatively moving the first bearing device (49) together with the friction wheel (4) held thereon along the guide arrangement (53) arranged or formed on the at least one cantilever arm (52) in a parallel direction with respect to the drive axis (8) of the drive shaft (44), removing the friction wheel 4 to be changed from the first bearing device 49 and arranging another friction wheel 4 on the first bearing device 49, adjusting back the first bearing device 49 along the guide arrangement 53 arranged or formed on the at least one cantilever arm 52 in the direction towards the main frame 5;

coupling the first bearing device 49 to the main frame 5 and in doing so, changing the coupling device 51 from its decoupling position to its coupling position.

It should also be noted that in the individual figures only individual machine components are shown and described individually. This makes it possible, for example, to use the sensor unit 25 with the temperature control element 27, if necessary, also with the shielding unit 28 in a plant or extrusion machine 1. If necessary, the sensor unit 25 could also be combined with the temperature control element 27 with the distance control according to FIGS. 4 and/or 5. The distance control according to FIGS. 4 and/or 5 can also be combined with the screening unit 28 in a plant or extrusion machine 1. However, based on the basic embodiment of the extrusion machine 1 described in FIG. 1, all the previously described system components could also be used in one system, namely the sensor unit 25 with the temperature control element 27 if necessary, the shielding unit 28 and the distance control according to FIGS. 4 and/or 5.

Figure 7:
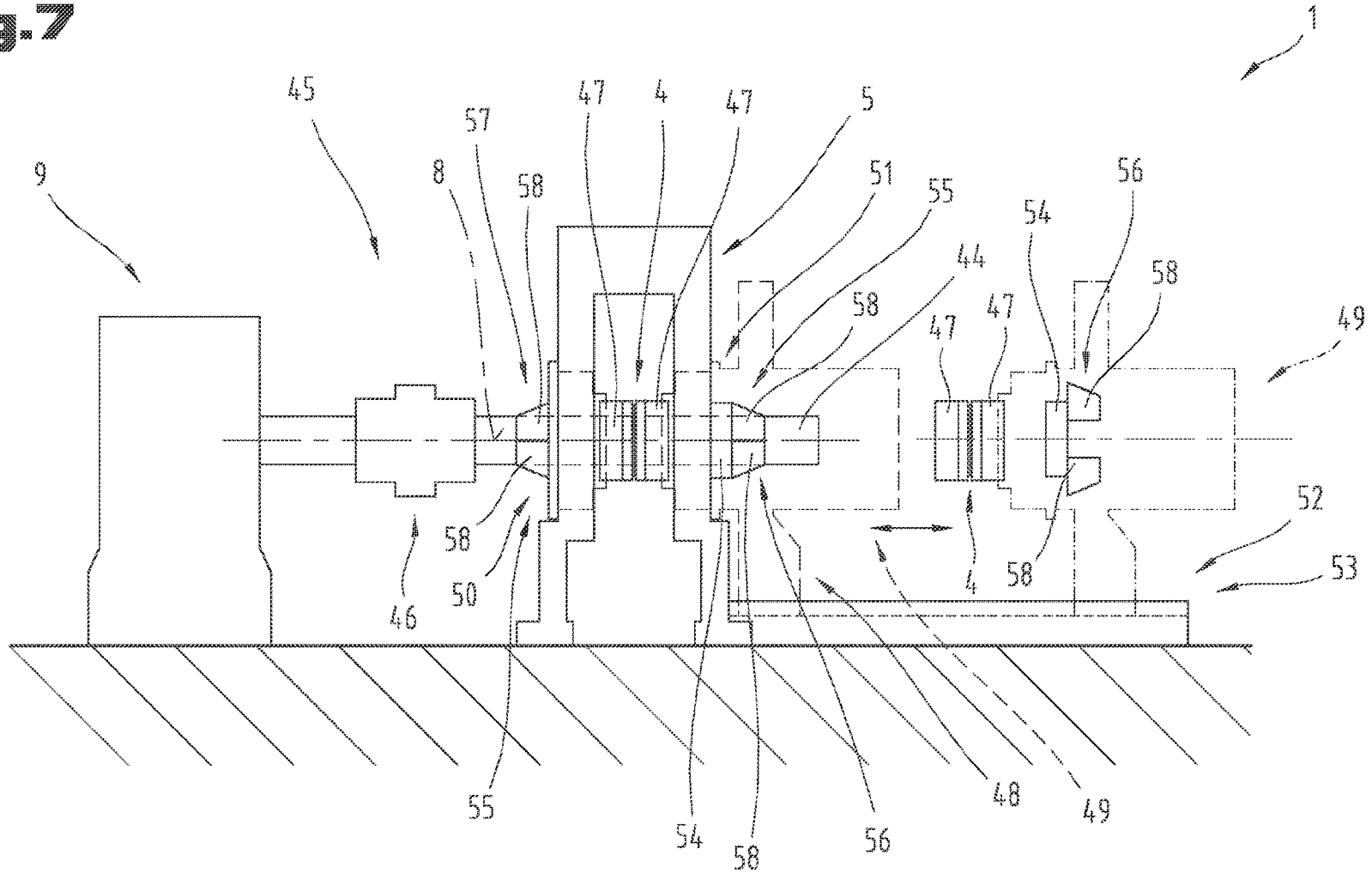
FIG. 7 shows another possible embodiment of an extrusion machine with a device for changing the friction wheel, in frontal view and highly stylised representation.

FIG. 7 describes in more detail an embodiment variant of the extrusion machine 1 shown and described in FIG. 6. The basic configuration of the extrusion machine 1 corresponds to that already described in detail in FIG. 6. Therefore, in order to avoid unnecessary repetition, reference is made to the detailed description in the preceding FIGS. 1 to 6. Likewise, the same reference numbers or component designations as in the preceding FIGS. 1 to 6 are used for identical parts.

As already described in FIG. 6 as a possible embodiment, the cantilever arm 52 can also be arranged below the drive shaft 44, as viewed in the vertical direction, and extends in parallel alignment with respect to the drive axis 8 defined by the drive shaft 44. In this case, the cantilever arm 52 is preferably supported on or rests on an unspecified support surface, such as a hall floor or a foundation surface specially provided for this purpose. The cantilever arm 52 can also be connected or attached to the main frame 5. The cantilever arm 52 can also be arranged or formed to extend from the main frame 5 to the side facing away from the drive unit 9.

The first bearing device 49 of the bearing unit 48 is then not in a hanging position but in a standing position or position rising from the floor side and is guided by means of the guide arrangement 53 on the at least one cantilever arm 52. This in turn allows, after loosening the coupling device 51 between the first bearing device 49 and the main frame 5, the entire first bearing device 49 together with the friction wheel 4 to be moved away from the drive shaft 44 to such an extent that easy access to the friction wheel 4 is possible.

In order to transmit the drive torque from the drive shaft 44 to the at least one friction wheel 4, a mutual axial tensioning of the drive shaft 44 with bearing components of the two bearing devices 49 and 50 as well as the friction wheel 4 located between them is carried out. By means of a tensioning device 54 a tensile force acting in axial direction is applied to the drive shaft 44 and thus those components supported or arranged on the drive shaft 44 are biased against each other. Thus the at least one friction wheel 4 can be held in a preferably clamped position non-rotatable on the drive shaft 44. Furthermore, the driving ring(s) 47 described above can also be provided and arranged on one side of friction wheel 4 or on both sides of friction wheel 4.

Figure 9:
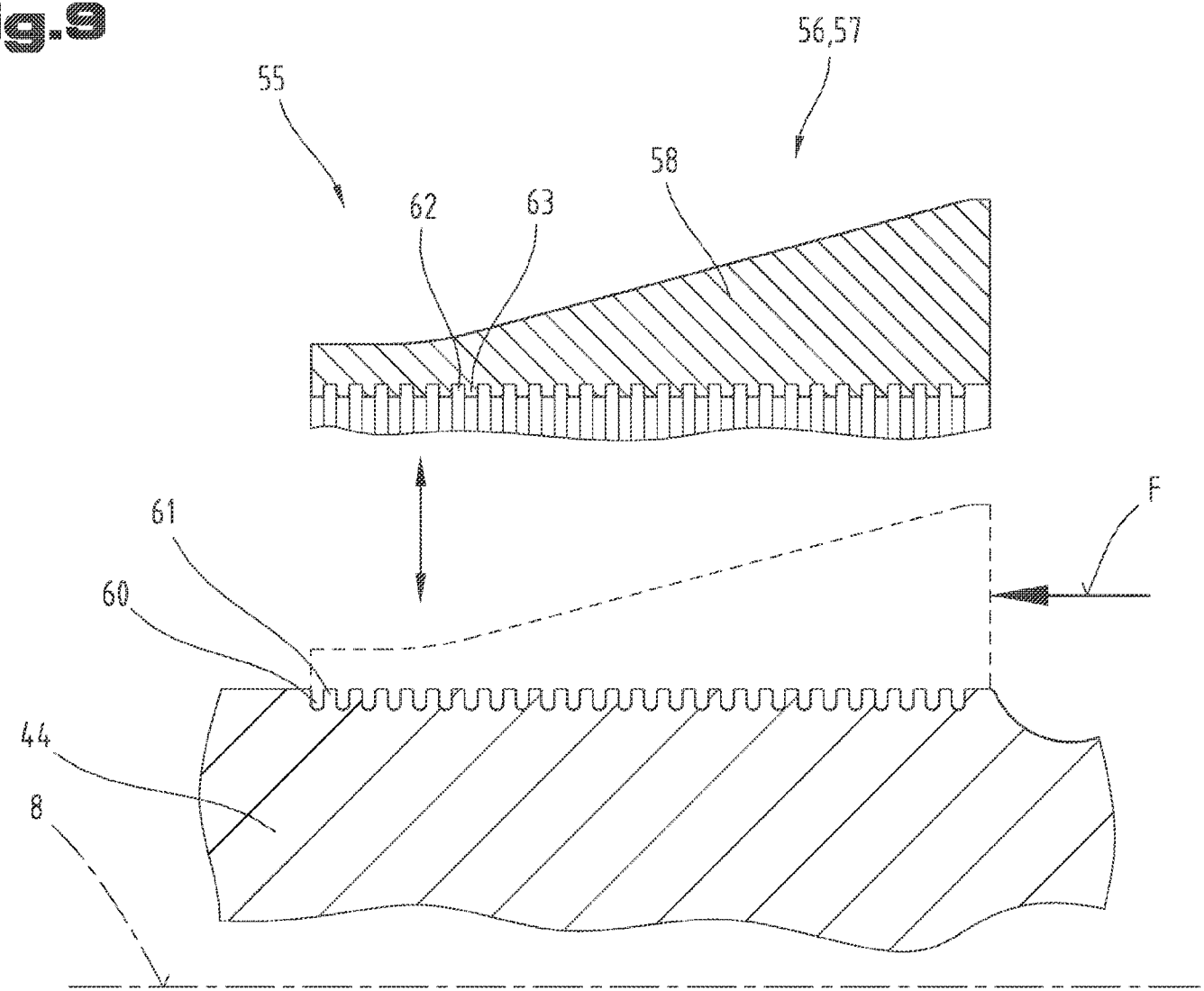
FIG. 9 shows a detail of a support arrangement with a portion of a drive shaft of the extrusion machine, in axial section as well as in radial direction, spaced apart arrangement of a support element from the drive shaft, in enlarged view.

A support arrangement 55 is provided here to support in the axial direction at least one of the bearing devices 49, 50 on the drive shaft 44. In this embodiment example, the support arrangement 55 comprises a first support device 56 and a second support device 57 on the sides of the two bearing devices 49, 50 facing away from each other. If the drive shaft diameters are the same, the support devices 56, 57 can be formed in the same way. Each of the support devices 56, 57 comprises at least two support elements 58, which are segment-shaped and surround or embrace the drive shaft 44 on the outside. In addition, the support elements 58 are supported in a form-fit manner in the axial direction on the drive shaft 44. If two support elements 58 are provided, these can be formed or designated as half-shells. By means of the tensioning device 54, which can be formed as a hydraulic motor, for example, an axial pressure force is built up. Due to the arrangement on both sides of the support devices 56, 57 and the tensioning device 54, which is located axially inside the support devices 56, 57, an axial tensile force is introduced into the drive shaft 44 during the tensioning process. In this arrangement, the tensioning device 54 is pushed onto the drive shaft 44 and is supported on it for longitudinal displacement. FIG. 9 shows an enlarged detail of support arrangement 55 on a portion of the drive shaft 44.

If a friction wheel is now to be changed, the compression force between the two support devices 56, 57 acting from the tensioning device 54 must be removed. Once this has been done, the support elements 58 of the first support device 56 shall be disengaged from the drive shaft 44. Subsequently, the entire first bearing device 49 together with the friction wheel 4, if necessary the driving ring(s) 47, the tensioning device 54 and the disengaged support elements 58 of the first support device 56 can be moved away from the drive shaft 44. This is done along the cantilever arm 52 and the previously described guide arrangement 53. The operating position or coupling position of the first bearing device 49 is shown in dotted lines to make it easier to see the tensioning device 54 and the first support device 56 on the drive shaft 44 inside it.

The decoupled position of the first bearing device 49, which is moved away or displaced away from the main frame 5, is shown in dash-dotted lines, but the friction wheel 4, the driving rings 47, the tensioning device 54 and the first support device 56 are shown in full lines. The support elements 58 of the first support device 56 are shown in a distanced position from each other. The movement away from drive axis 8 can be carried out, for example, by means of a pivot movement or a sliding movement in the radial direction.

The double-sided arrangement of both the first support device 56 and the second support device 57 can also be used on the extrusion machine 1 described in FIG. 6 with the suspended arrangement of the first support device 49 on the cantilever arm 52.

Figure 8:
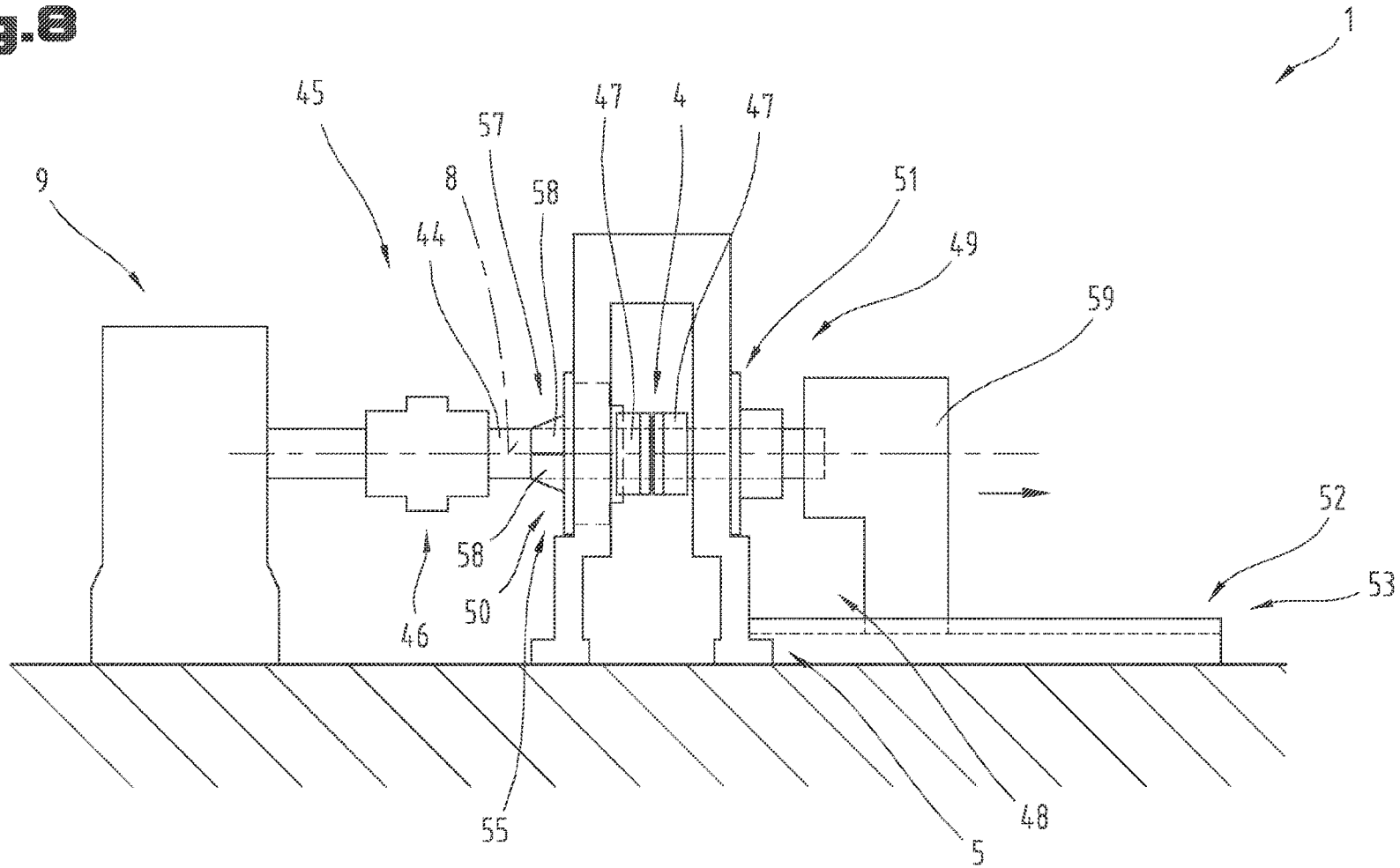
FIG. 8 shows another possible embodiment example of an extrusion machine with a device for changing the friction wheel, in frontal view and highly stylized representation.

FIG. 8 describes in more detail an embodiment variant of the extrusion machine 1 shown and described in FIGS. 6 and 7. The basic configuration of the extrusion machine 1 corresponds to that already described in detail in FIGS. 6 and 7. Therefore, in order to avoid unnecessary repetition, reference is made to the detailed description in the preceding FIGS. 1 to 7. Likewise, the same reference signs or component designations as in the preceding FIGS. 1 to 7 are used for identical parts.

In this embodiment variant of the extrusion machine 1 described here, it is provided that, in contrast to the previously described embodiment variants, the drive shaft 44 is pulled out of the second bearing device 50 on the side facing away from the drive device 9 in the axial direction to such an extent that the friction wheel 4 and the driving ring(s) 47 are no longer located on the drive shaft 44.

For axial support of the tensioning force built up by the tensioning device 54 for holding the friction wheel 4 on the drive shaft 44, a support device 56 is provided here only in the area of the second bearing device 50 on the side of the second bearing device 50 facing away from the friction wheel 4. The tensioning device 54 is arranged on the drive shaft 44 on the side of the first bearing device 49 facing away from the second bearing device 50 and is held directly on the drive shaft 44 in a fixed position in the axial direction. This can be done, for example, by means of a thread arrangement with form-fit locking.

In order to be able to displace the drive shaft 44 in axial direction for the friction wheel change relative to the main frame 5 and the bearing devices 49, 50, the tensioning force built up by the tensioning device 54 must be removed. In the following, the coupling connection of the drive shaft 44 in the area of the coupling 46 is to be released. The coupling connection can be made e.g. by means of a splined coupling or similar. Furthermore, the support elements 58 of the support device 56 must be disengaged from the drive shaft 44. Subsequently, the decoupled drive shaft 44 can then, if necessary together with the tensioning device 54, be moved in the axial direction out of the second bearing device 50, in particular pulled out, and the friction wheel 4 can be released from its bearing seat on the drive shaft 44. The friction wheel 4 as well as the driving ring(s) 47 remain between the two bearing devices 49, 50 until the drive shaft 44 releases them and can be removed from the extrusion machine 1 for friction wheel replacement. For longitudinal adjustment of the drive shaft 44 and possible support, the cantilever arm 52 described above in FIG. 7 together with the guide arrangement 53 can be used, which can be arranged on the ground or also vertically above the drive shaft 8.

Furthermore, it is also shown that the drive shaft 44 is supported by an auxiliary slide 59 to support it during its axial longitudinal adjustment along the guide arrangement 53 of the cantilever arm 52. The auxiliary slide 59 is guided on the guide arrangement 53, whereby the drive shaft 44 together with the auxiliary slide 59 can be displaced relative to the stationary first bearing device 49 or the main frame 5. It would also be possible to arrange the cantilever arm 52 vertically above the drive axis 8.

FIG. 9 shows a possible design of one of the support elements 58 of one of the support devices 56, 57 in axial section and enlarged view. One support element 58 is additionally distanced from the drive shaft 44 in the radial direction and is therefore shown out of engagement with the latter. The engagement position between the support element 58 and the drive shaft 44 is indicated in dotted lines.

The mutual support in axial direction between the support elements 58 and the drive shaft 44 is achieved by means of a form-fit locking retaining connection. For this purpose, the drive shaft 44 is provided with a large number of groove-shaped first recesses 60, one behind the other in the axial direction and spaced from each other, between which first support flanges 61 are formed. Depending on the axial force to be supported, the number of load-transmitting first support flanges 61 must be selected. The groove-shaped recesses 60 can be formed, for example, by means of so-called recesses in the drive shaft 44.

The support elements 58 are each provided on their inner surfaces facing the drive shaft 44 with counterpart groove-shaped second recesses 62 and second support flanges 63 formed between them. The second support flanges 63 engage almost without play in the first groove-shaped recesses 60 and vice versa.

Furthermore, it can be seen that the support elements 58, as seen in axial section, have a conical or conical tapering cross-section starting from the force application side—according to arrow "F". This ensures that a uniformly distributed force introduction or force transmission can be achieved between the engaged first and second support flanges 61, 63 over the entire number of them. With a thread arrangement, only the first threads are usually load-transmitting, which leads to overloading and damage to the threads.

The examples show possible variations, whereby it should be noted at this point that the invention is not limited to the specially presented variations, but rather that various combinations of the individual variations are also possible and that this possibility of variation is due to the teaching of technical action by means of the invention in question in the skill of the person skilled in this technical field.

The scope of protection is determined by the claims. However, the description and the drawings shall be used to interpret the claims. Individual features or combinations of features from the different examples of embodiment shown and described can represent independent inventive solutions. The task underlying the independent inventive solutions can be found in the description.

All information on value ranges in the description in question is to be understood in such a way that it includes any and all sub-ranges thereof, e.g. 1 to 10 is to be understood in such a way that all sub-ranges starting from the lower limit 1 and the upper limit 10 are included, i.e. all sub-ranges start with a lower limit of 1 or greater and end with an upper limit of 10 or less, e.g. 1 to 1.7, or 3.2 to 8.1, or 5.5 to 10.

For the sake of order, it should be pointed out in conclusion that, for a better understanding of the structure, elements have sometimes been shown in an unscaled and/or enlarged and/or reduced scale.

Although only a few embodiments of the present invention have been shown and described, it is to be understood that many changes and modifications may be made thereunto without departing from the spirit and scope of the invention.

LIST OF REFERENCE NUMBERS

1 extrusion machine
2 profile
3 extrusion material
4 friction wheel
5 main frame
6 tool holding device
7 pivot axis
8 drive axis
9 drive unit
10 pressure roller
11 locking device
12 tool unit
13 end area
14 adjusting device
15 adjusting element
16 adjusting surface
17 guide surface
18 support surface
19 pressure unit
20 Pressure element
21 pressure chamber
22 accommodation chamber
23 first positioning surface
24 second positioning surface
25 first sensor unit
26 sensor
27 temperature control element
28 shielding unit
29 peripheral portion
30 stripping area
31 stripping element
32 first nozzle
33 second nozzle
34 butterfly valve
35 further arrangement of nozzles
36 control and/or regulating device
37 distance measuring device
38 tool end surface
39 sensor
40 scraping device
41 scraping element
42 basic housing
43 actuator
44 drive shaft
45 drive unit
46 coupling
47 driving ring
48 bearing unit
49 first bearing device
50 second bearing device
51 coupling device
52 cantilever arm
53 guide arrangement
54 tensioning device
55 support arrangement
56 first support device
57 second support device
58 support element
59 auxiliary slides
60 first recess
61 first support flange
62 second recess
63 second support flange

What is claimed is:

1. An extrusion machine (1) for continuous manufacture of profiles (2) from a moldable extrusion material (3), comprising a main frame (5), a drive unit (45) with a drive device (9) and with a drive shaft (44), which drive shaft (44) defines a drive axis (8);

at least one friction wheel (4) rotatable about the drive shaft (8), which friction wheel (4) is provided with at least one peripheral groove and is in drive connection with the drive device (9), a bearing unit (48) with a first bearing device (49) and with a second bearing device (50), the bearing devices (49, 50) being arranged on both sides of the friction wheel (4), and by means of which bearing devices (49, 50) the drive shaft (44) is rotatable mounted on the main frame (5), a tool holding device (6), which tool holding device (6) is mounted on a pivot axis (7) held on the main frame (5) and can be pivoted about the pivot axis (7) between a working position and a release position, wherein the tool holding device (6) is arranged downstream of the friction wheel (4), as viewed in the pass-through direction of the profile (2) to be manufactured, a locking device (11), which locking device (11) holds in its locking position the tool holding device (6) locked in its working position relative to the main frame (5), and at least one tool unit (12), which tool unit (12) is supported on the tool holding device (6), wherein at least one cantilever arm (52) is provided, which at least one cantilever arm (52) is arranged or formed extending in parallel direction with respect to the drive axis (8), a guide arrangement (53) is provided, which guide arrangement (53) is arranged or formed on the at least one cantilever arm (52), at least one coupling device (51) is provided, the coupling device (51) having a coupling position and a decoupling position, and that the first bearing device (49) is coupled to the main frame (5) when the coupling device (51) is in the coupling position, and the first bearing device (49) is guided on the cantilever arm (52) so as to be adjustable along the cantilever arm (52) by means of the guide arrangement (53) when the coupling device (51) is in the decoupling position, wherein the at least one cantilever arm (52) is arranged vertically above the drive shaft (44) and the first bearing device (49) is held guided in suspended arrangement on the at least one cantilever arm (52), wherein the first bearing device (49) is solely carried by the cantilever arm (52) when the coupling device (51) is in the decoupling position and the first bearing device (49) can be positioned in a detached or cantilevered position shifted or displaced away from the base frame (5) in a parallel direction with respect to the drive axis (8), so that access for carrying out a friction wheel change process is enabled from multiple sides.

2. The extrusion machine (1) according to claim 1, wherein the second bearing device (50) together with the drive shaft (44) is arranged in a stationary manner on the main frame (5).

3. The extrusion machine (1) according to claim 1, wherein the at least one cantilever arm (52) extends from the main frame (5) to the side facing away from the drive device (9).

4. The extrusion machine (1) according to claim 1, wherein the at least one cantilever arm (52) is held on the main frame (5).

5. The extrusion machine (1) according to claim 1, wherein the at least one friction wheel (4) is held on the first bearing device (49), if necessary with the interposition of a driving ring (47).

6. The extrusion machine (1) according to claim 1, wherein a support arrangement (55) is provided and the support arrangement (55) comprises at least one support device (56, 57), which at least one support device (56, 57) is or are arranged on at least one side, preferably on both sides facing away from the friction wheel (4), of the bearing devices (49, 50) on the drive shaft (44) in a form-fit position in the axial direction.

7. The extrusion machine (1) according to claim 6, wherein the support device (56, 57) comprises at least two support elements (58) and the at least two support elements (58) are arranged on the outside of the drive shaft (44).

8. The extrusion machine (1) according to claim 7, wherein a plurality of groove-shaped first recesses (60) arranged spaced apart from one another in the axial direction are provided in the drive shaft (44) and a respective first support flange (61) is formed between directly axially adjacent first recesses (60), and wherein the support elements (58) have second recesses (62) of opposite design and a respective second support flange (63) is formed between second recesses (62) arranged directly adjacent in the axial direction.

9. A method for changing a friction wheel (4) of an extrusion machine (1) for the continuous manufacture of profiles (2) from a moldable extrusion material (3), which friction wheel is in drive connection with a drive device (9) and is rotatable about a drive axis (8) defined by a drive shaft (44), the method comprising the following steps:

decoupling a coupling device (51) located between a first bearing device (49) and a main frame (5) of the extrusion machine (1) and thereby displacing it from its coupling position into its decoupling position, relatively moving the first bearing device (49) together with the friction wheel (4) held thereon along a guide arrangement (53) arranged or formed on at least one cantilever arm (52) in a parallel direction with respect to the drive axis (8) of the drive shaft (44), wherein the first bearing device (49) is held guided on the cantilever arm (52) located vertically above the drive shaft (44) in a suspended arrangement on the at least one cantilever arm (52), wherein the first bearing device (49) together with the friction wheel (4) held thereon is solely carried by the cantilever arm (52), positioning the first bearing device (49) together with the friction wheel (4) held thereon in a detached or cantilevered position shifted or displaced away from the base frame (5), so that access for carrying out a friction wheel change process is enabled from multiple sides, removing the friction wheel (4) to be changed from the first bearing device (49) and arranging another friction wheel (4) on the first bearing device (49), adjusting back the first bearing device (49) along the guide arrangement (53) arranged or formed on at least one cantilever arm (52) towards the main frame (5), and coupling the first bearing device (49) to the main frame (5) and in doing so, changing the coupling device (51) from its decoupling position to its coupling position.

10. The method according to claim 9, wherein the drive shaft (44) and a second bearing device (50) supporting the drive shaft (44) remain stationary on the main frame (5) during the friction wheel change process.

11. An extrusion machine (1) for the continuous manufacture of profiles (2) from a moldable extrusion material (3), comprising a main frame (5), a drive unit (45) with a drive device (9) and with a drive shaft (44), which drive shaft (44) defines a drive axis (8);

at least one friction wheel (4) rotatable about the drive shaft (8), which friction wheel (4) is provided with at least one peripheral groove and is in drive connection with the drive device (9), a bearing unit (48) with a first bearing device (49) and with a second bearing device (50), wherein the bearing devices (49, 50) are arranged on both sides of the friction wheel (4), and by means of which bearing devices (49, 50) the drive shaft (44) is rotatable mounted on the main frame (5), a tool holding device (6), which tool holding device (6) is mounted on a pivot axis (7) held on the main frame (5) and can be pivoted about the pivot axis (7) between a working position and a release position, the tool holding device (6) being positioned downstream of the friction wheel (4), as viewed in the pass-through direction of the profile (2) to be manufactured, a locking device (11), which locking device (11) in its locking position holds the tool holding device (6) locked in its working position relative to the main frame (5), and at least one tool unit (12), which tool unit (12) is supported on the tool holding device (6), wherein at least one cantilever arm (52) is provided, which at least one cantilever arm (52) is arranged or formed extending in parallel direction with respect to the drive axis (8), wherein the at least one cantilever arm (52) is arranged vertically above the drive shaft (44) and the first bearing device (49) is held guided in suspended arrangement on the at least one cantilever arm (52), a guide arrangement (53) is provided, which guide arrangement (53) is arranged or formed on the at least one cantilever arm (52), a support arrangement (55) is provided with a support device (56, 57), the support device (56, 57) is arranged on the side of the second bearing device (50) facing away from the friction wheel (4) and on the side facing the drive device (9) on the drive shaft (44) in a form-fit position in the axial direction, and the support device (56, 57) comprises at least two support elements (58) and the at least two support elements (58) are arranged on the outside of the drive shaft (44).

12. The extrusion machine (1) according to claim 11, wherein a plurality of groove-shaped first recesses (60) arranged spaced apart from one another in the axial direction are provided in the drive shaft (44) and a first support flange (61) is formed in each case between first recesses (60) directly adjacent in the axial direction, and wherein the support elements (58) have second recesses (62) of opposite design and a second support flange (63) is formed in each case between second recesses (62) arranged directly adjacent in the axial direction.

13. A method for changing a friction wheel (4) of an extrusion machine (1) for the continuous manufacture of profiles (2) from a moldable extrusion material (3), which friction wheel is in drive connection with a drive device (9) and is rotatable about a drive axis (8) defined by a drive shaft (44), the method comprising the following steps:

removal of the axial tensioning force applied by a tensioning device (54) between the friction wheel (4) and the drive shaft (44), release of the coupling connection between the drive shaft (44) and a coupling (46) of a drive unit (45), release of the form-fit engagement of at least two support elements (58) of a support device (56, 57) with the drive shaft (44), displacing the drive shaft (44) in the axial direction relative to a bearing device (49, 50) held on both sides of the friction wheel (4) on a main frame (5), wherein the relative displacement of the drive shaft (44) on at least one cantilever arm (52) along a guide arrangement (53) arranged or formed on the at least one cantilever arm (52) is carried out in a parallel direction with respect to the drive axis (8) of the drive shaft (44) at least until the friction wheel (4) can be removed from the drive shaft (44), wherein the drive shaft (44) is held guided on the cantilever arm (52) located vertically above the drive shaft (44) in a suspended arrangement on the at least one cantilever arm (52), removal of the friction wheel (4) to be changed and arranging another friction wheel (4) between the two bearing devices (49, 50), adjusting back the drive shaft (44) and coupling the drive shaft (44) to the clutch (46) of the drive unit (45), arranging the at least two support elements (58) of the support device (56, 57) on the drive shaft (44) in a form-fit engagement with the drive shaft (44), and applying the axial tensioning force between the friction wheel (4) and the drive shaft (44) by means of the tensioning device (54).

* * * * *